US007513402B2

(12) United States Patent
Miyashita et al.

(10) Patent No.: US 7,513,402 B2
(45) Date of Patent: Apr. 7, 2009

(54) POWER TOOL

(75) Inventors: Isao Miyashita, Anjo (JP); Yukiyasu Okouchi, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 11/544,710

(22) Filed: Oct. 10, 2006

(65) Prior Publication Data

US 2007/0102470 A1 May 10, 2007

(30) Foreign Application Priority Data

Oct. 19, 2005 (JP) ..... 2005-305091
Oct. 28, 2005 (JP) ..... 2005-314302

(51) Int. Cl.
*B25C 5/02* (2006.01)

(52) U.S. Cl. ..... 227/8; 227/131; 227/132

(58) Field of Classification Search ..... 227/2, 227/4–8, 131, 132–134; 173/216, 217
See application file for complete search history.

(56) References Cited

U.S. PATENT DOCUMENTS 4,834,278 A * 5/1989 Lin ..... 227/7
4,953,774 A * 9/1990 Lai ..... 227/131
5,004,140 A * 4/1991 Fushiya et al. ..... 227/8
5,118,023 A * 6/1992 Fushiya et al. ..... 227/8
5,605,268 A * 2/1997 Hayashi et al. ..... 227/8
6,997,367 B2 * 2/2006 Hu ..... 227/132
7,004,367 B1 * 2/2006 Shen et al. ..... 227/8
7,121,443 B2 * 10/2006 Sun et al. ..... 227/131
7,152,774 B2 * 12/2006 Chen ..... 227/131
7,284,511 B2 * 10/2007 Zahner et al. ..... 123/46 H

FOREIGN PATENT DOCUMENTS

JP A 04-002474 1/1992
JP U 7-37576 7/1995

* cited by examiner

*Primary Examiner*—Thanh K Truong
(74) *Attorney, Agent, or Firm*—Oliff & Berridge, PLC

(57) ABSTRACT

It is an object of the invention to provide an improvement of the operability in a driving operation using a power tool. A representative power tool may comprise a driving material driven into a workpiece, a driving mechanism to drive the driving material into the workpiece, a motor, an operating device that controls energization and de-energization of the motor including a trigger switch and an internal switch, wherein the operating device further comprising a first mode in which, when the trigger switch is depressed, the internal switch is interlocked with the depressing operation of the trigger switch to be turned to the on-position and held in the on-position, while the trigger switch is returned to the off-position when the trigger switch is released and a second mode in which, when the depressing operation of the trigger switch is continued, the trigger switch is held in the on-position, and the internal switch is released from interlock with the trigger switch and is held in the on-position for a predetermined period of time in the working stroke and then returned to the off-position, while the trigger switch is returned to the off-position when the trigger switch is released.

13 Claims, 24 Drawing Sheets

FIG. 6
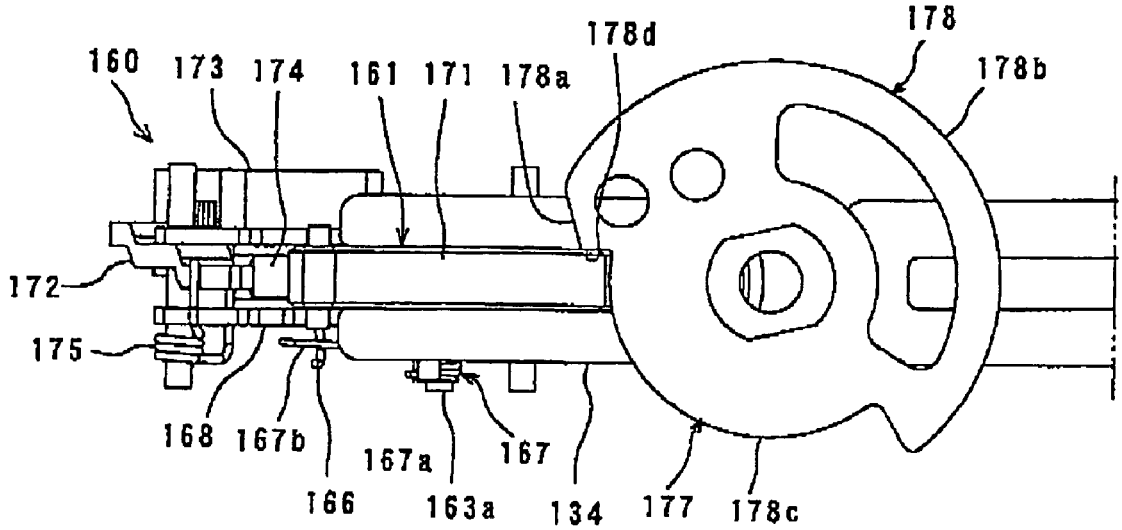
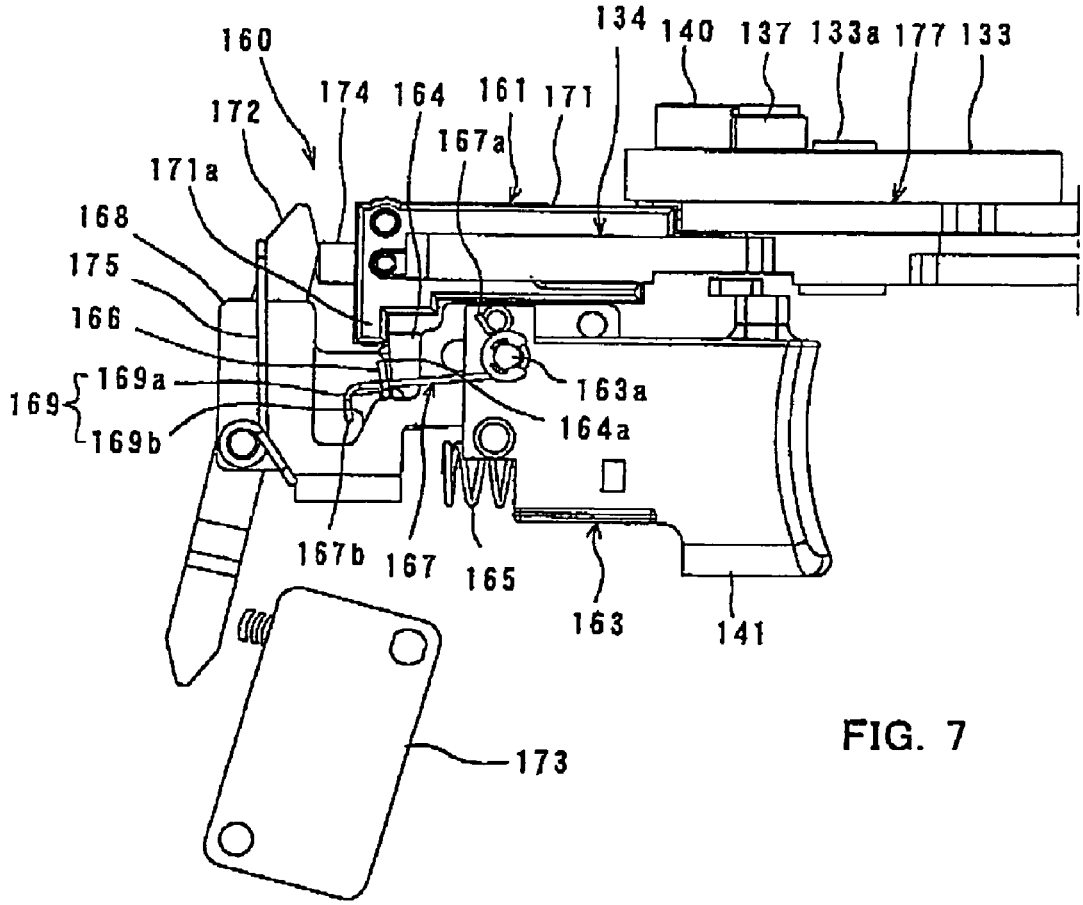
FIG. 7

FIG. 8
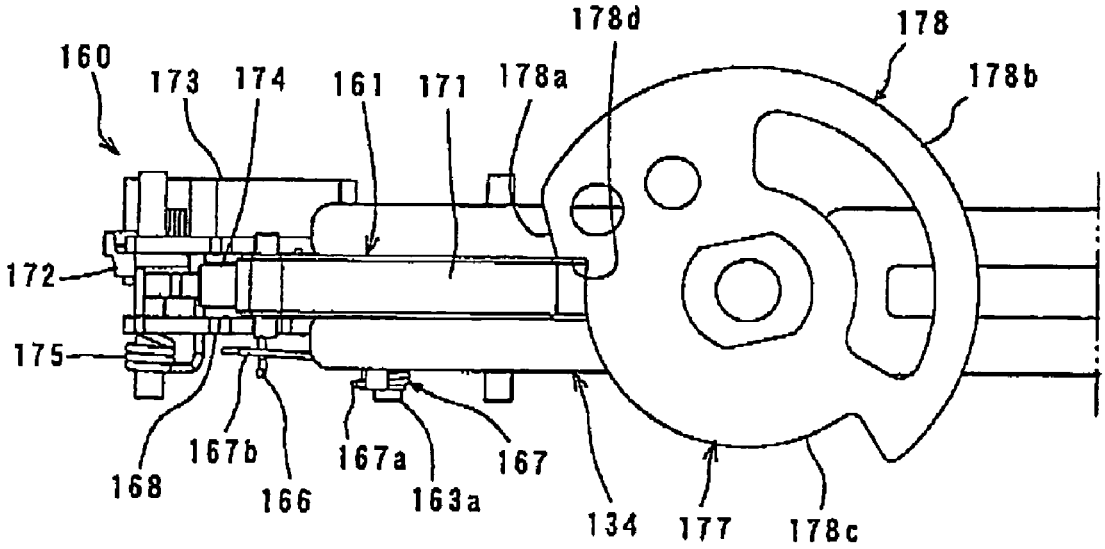
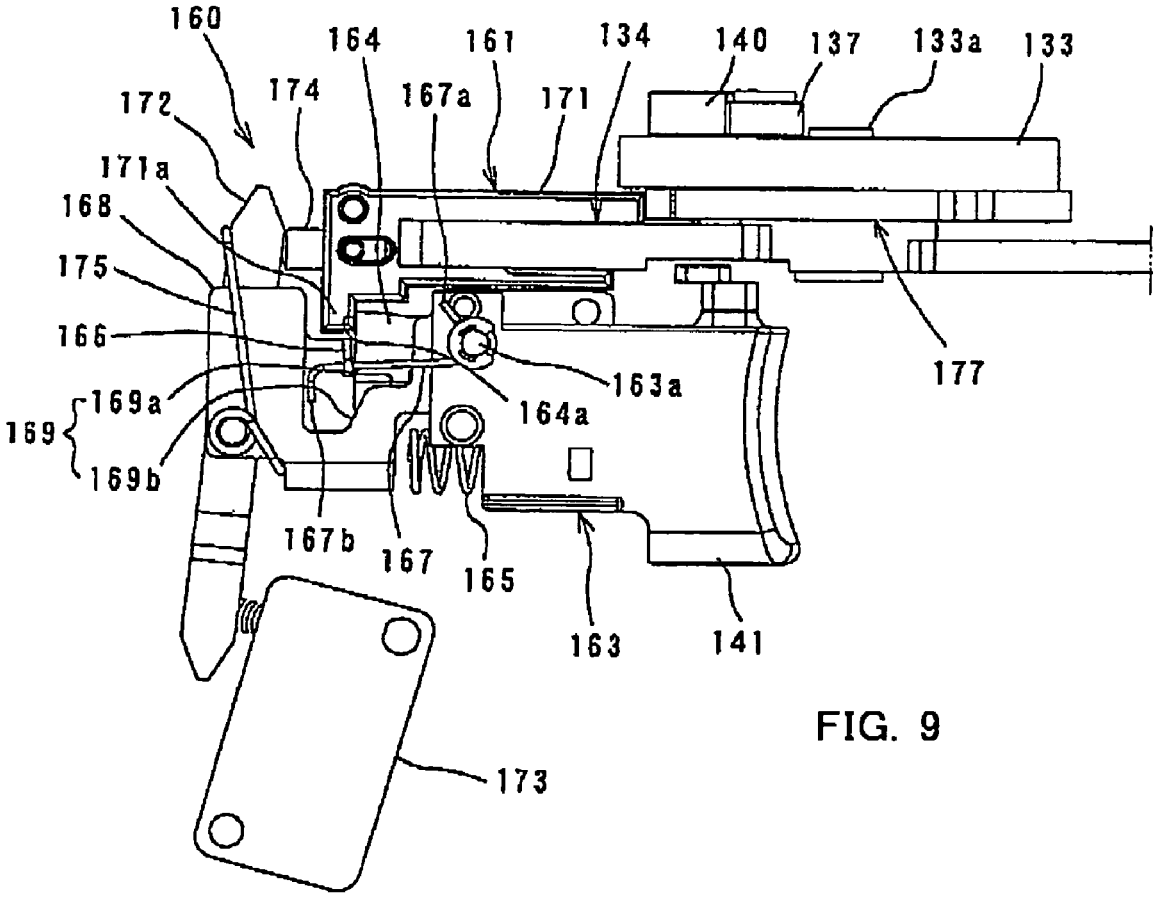
FIG. 9

FIG. 10
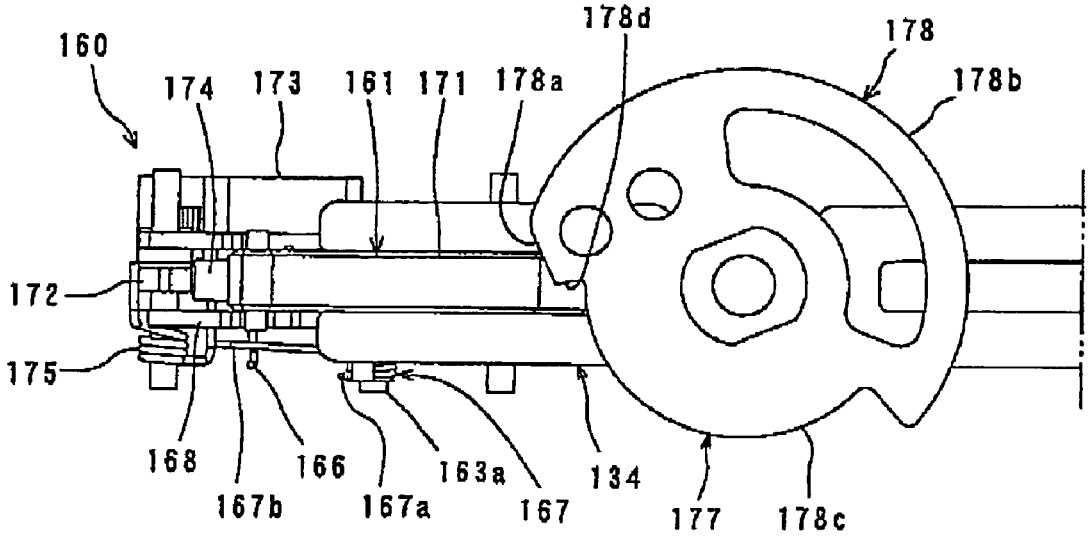
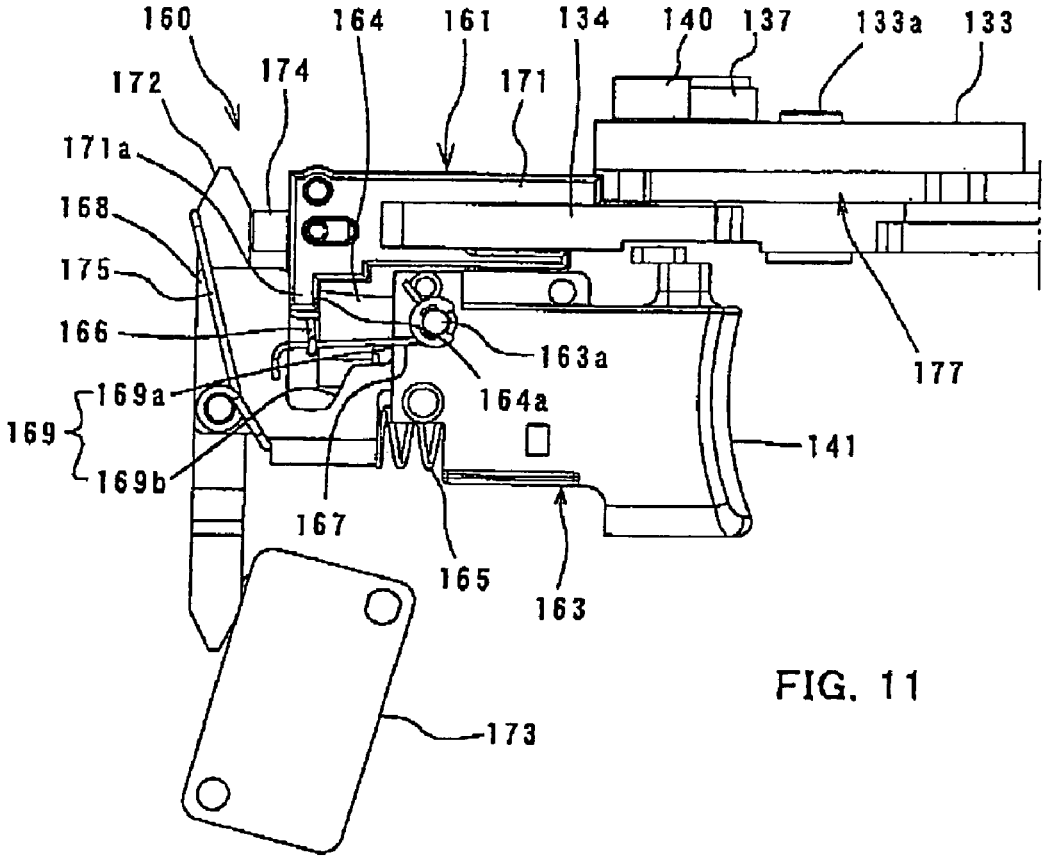
FIG. 11

FIG. 12
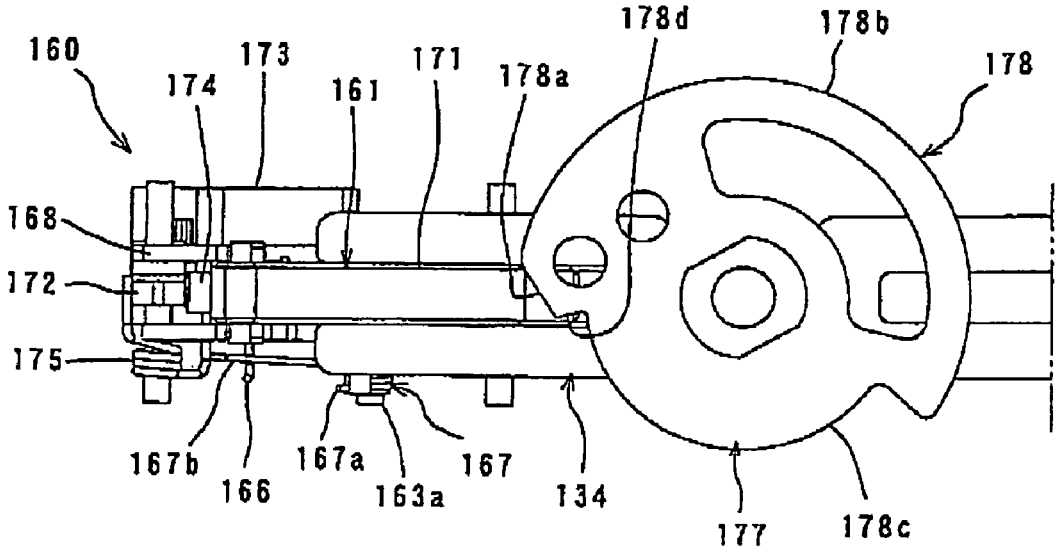
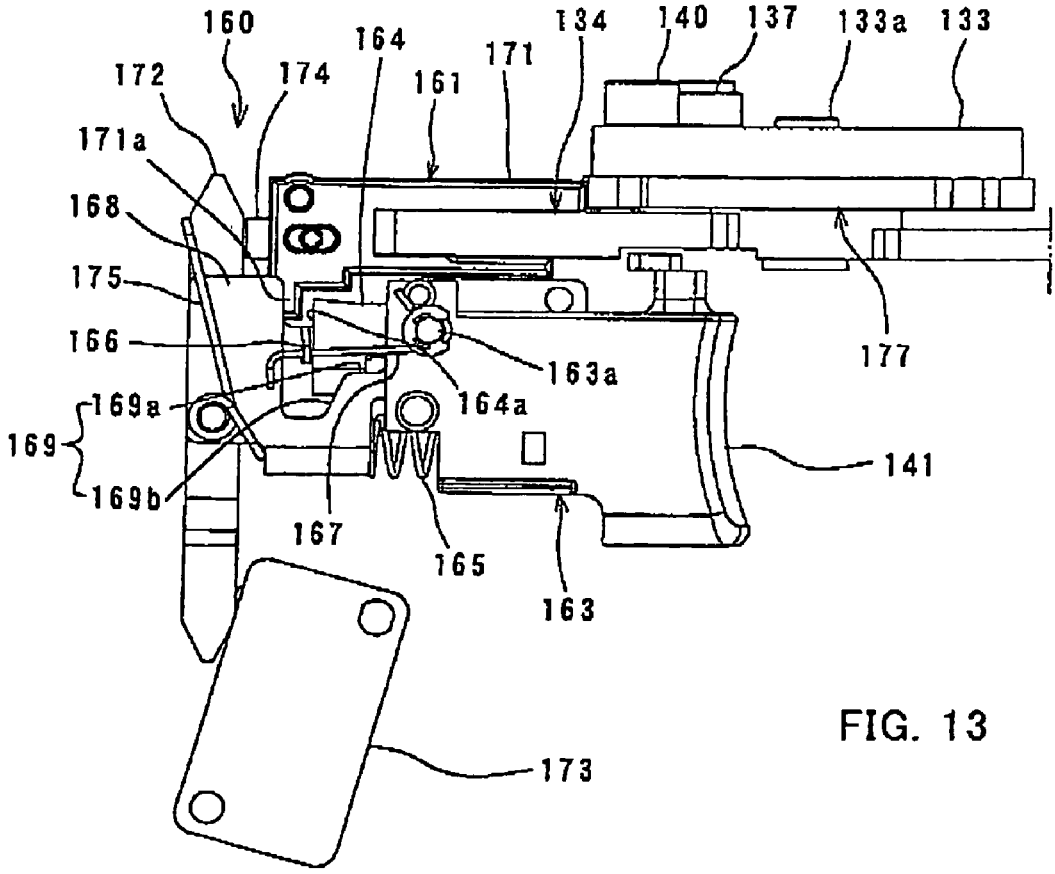
FIG. 13

FIG. 14
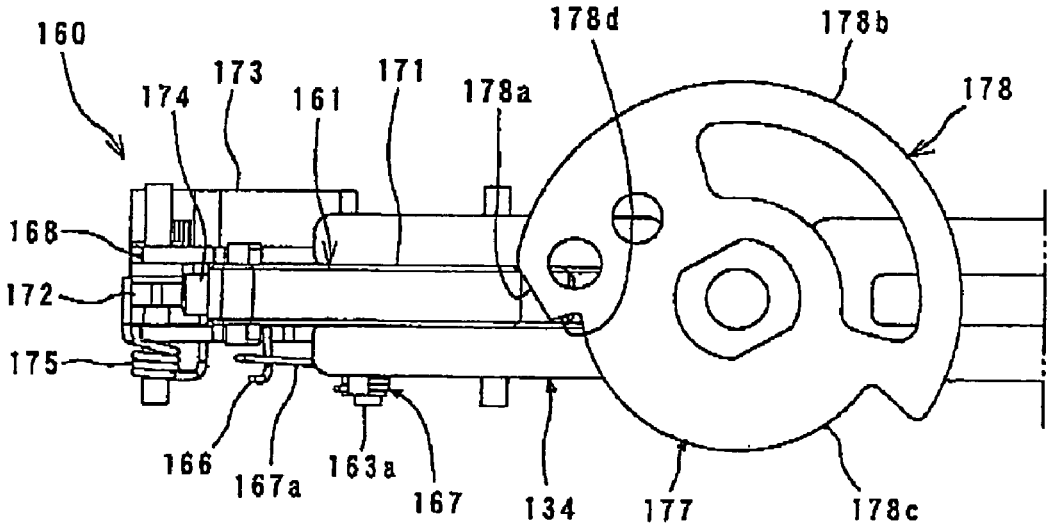
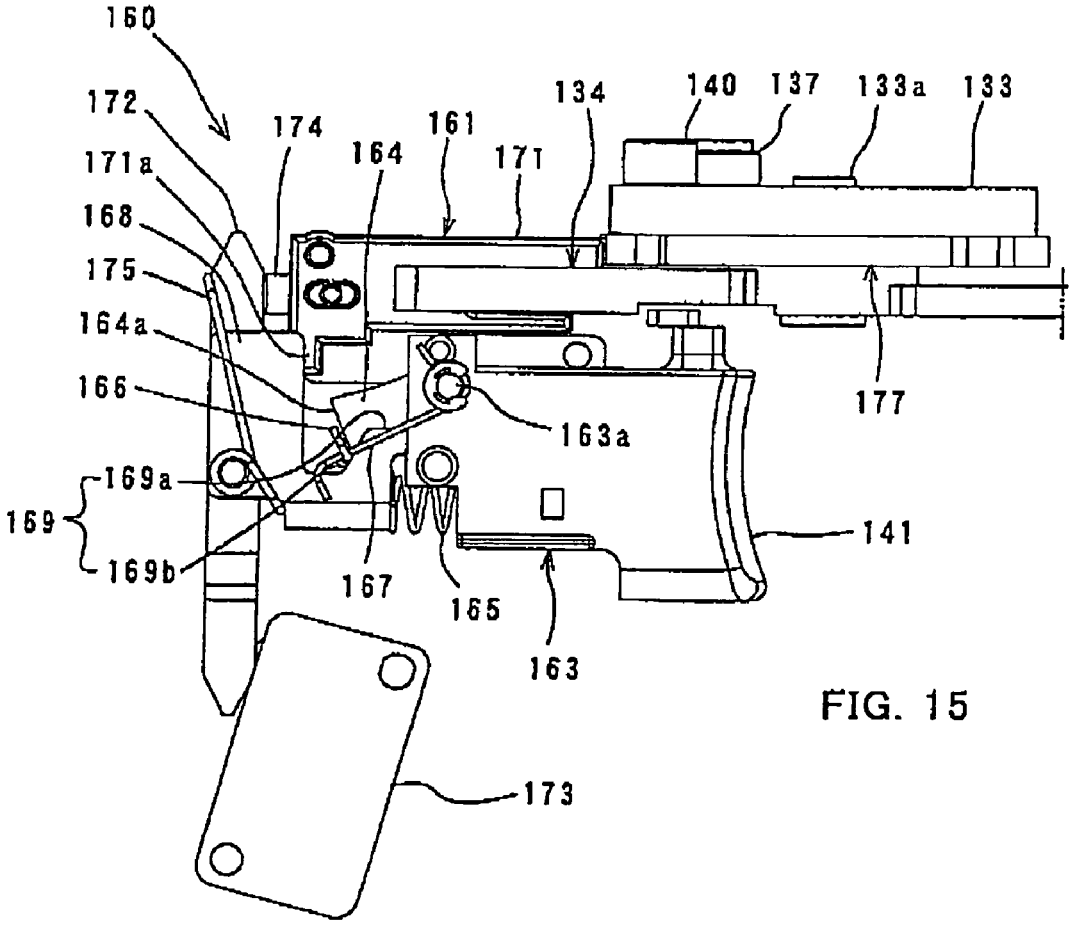
FIG. 15

FIG. 16
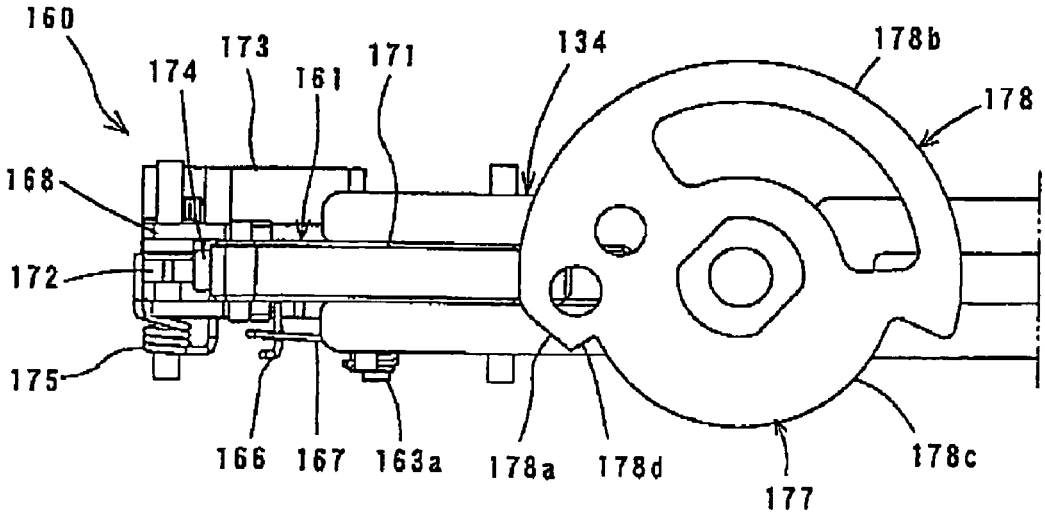
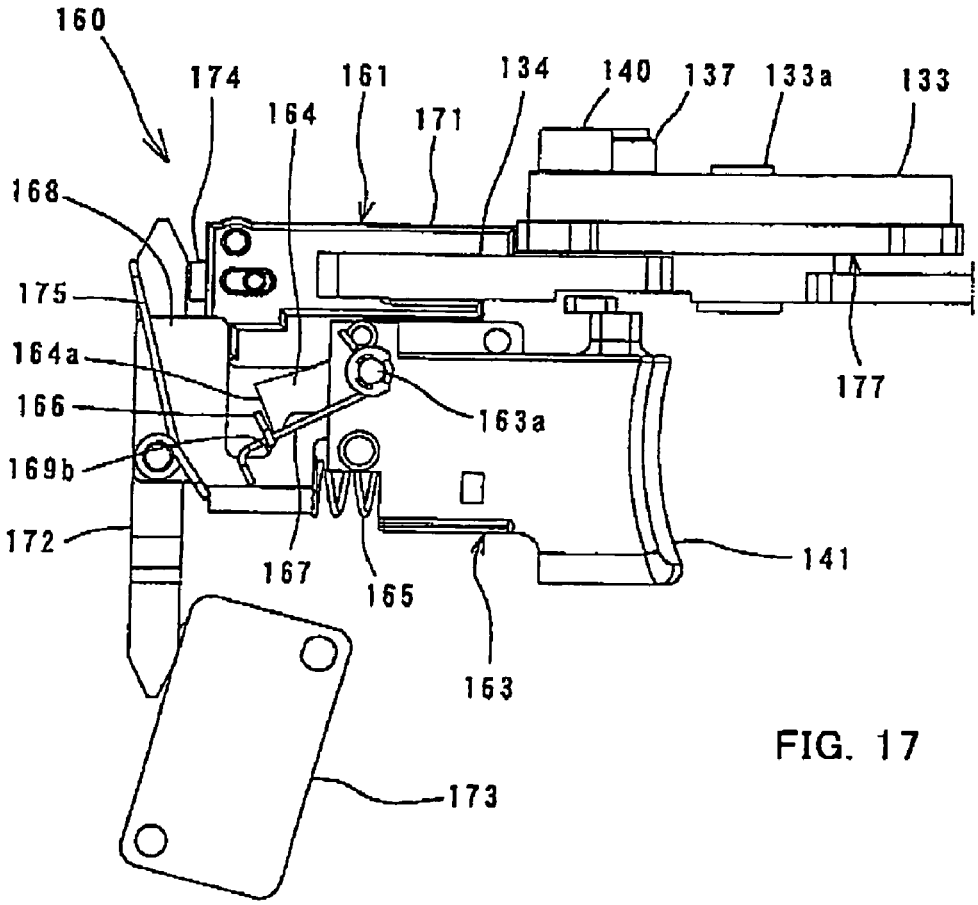
FIG. 17

FIG. 18
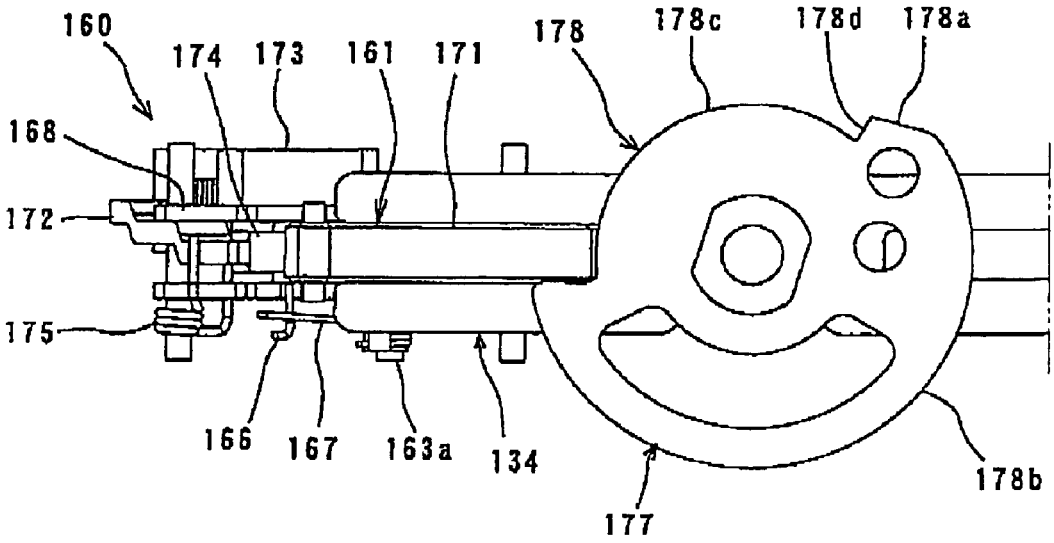
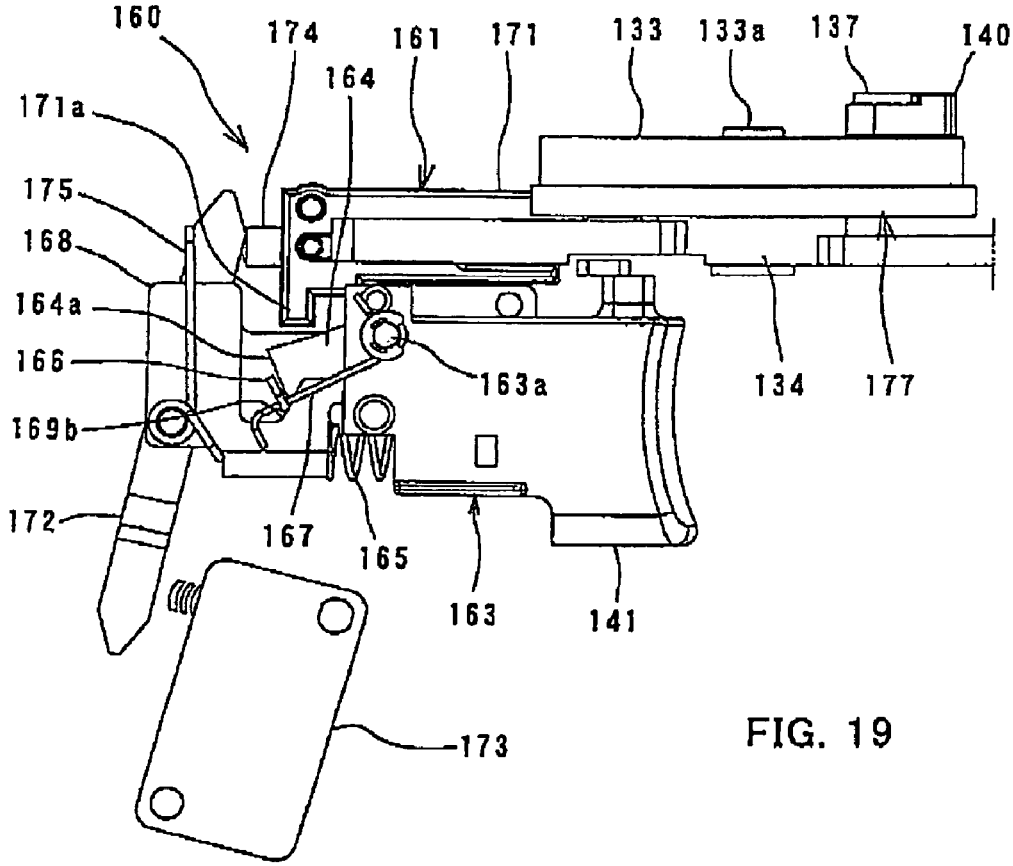
FIG. 19

FIG. 20
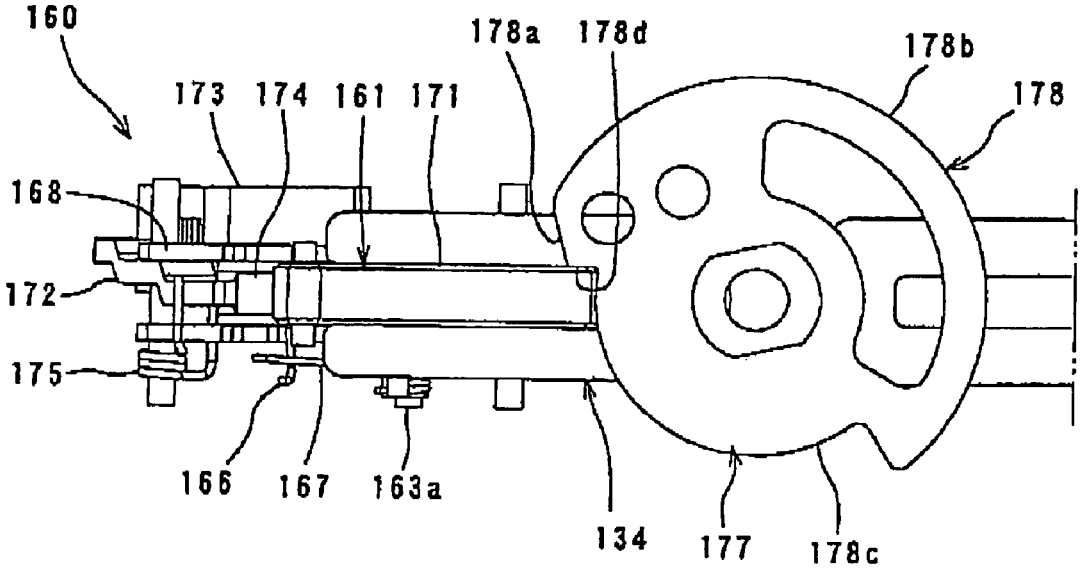
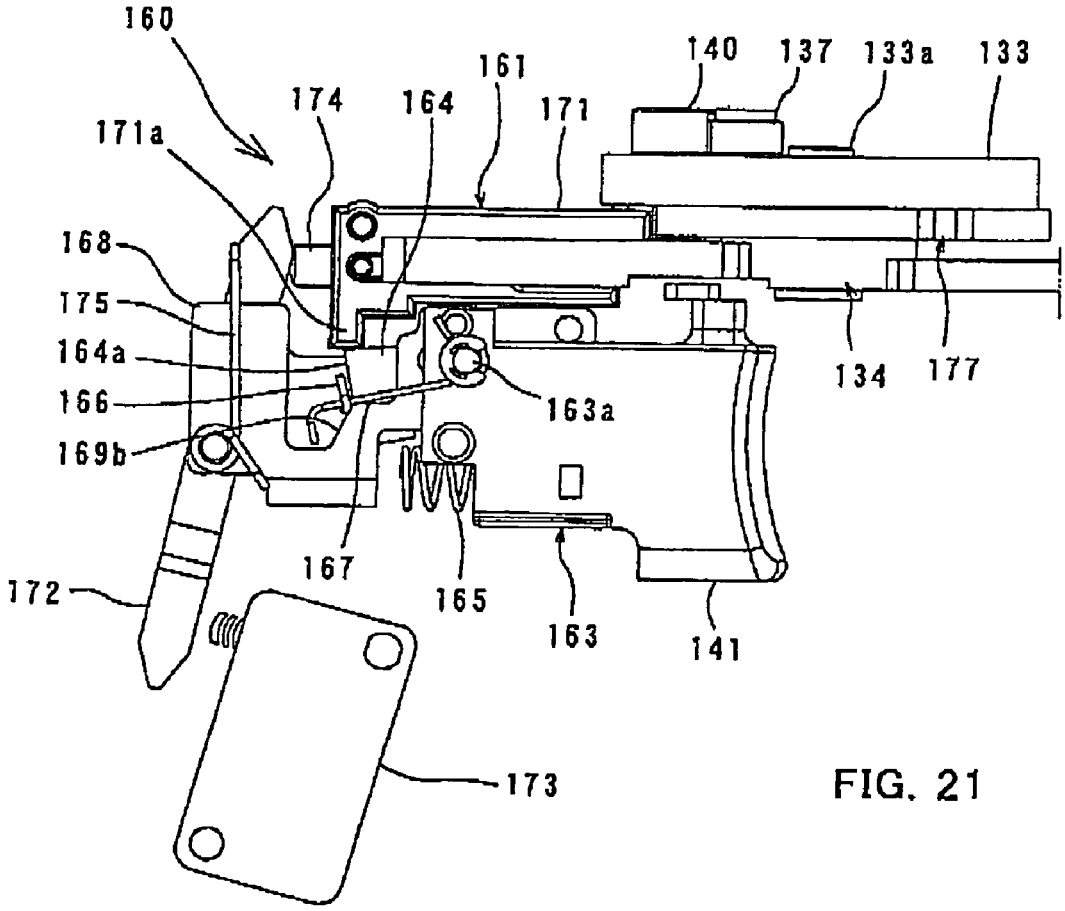
FIG. 21

FIG. 34
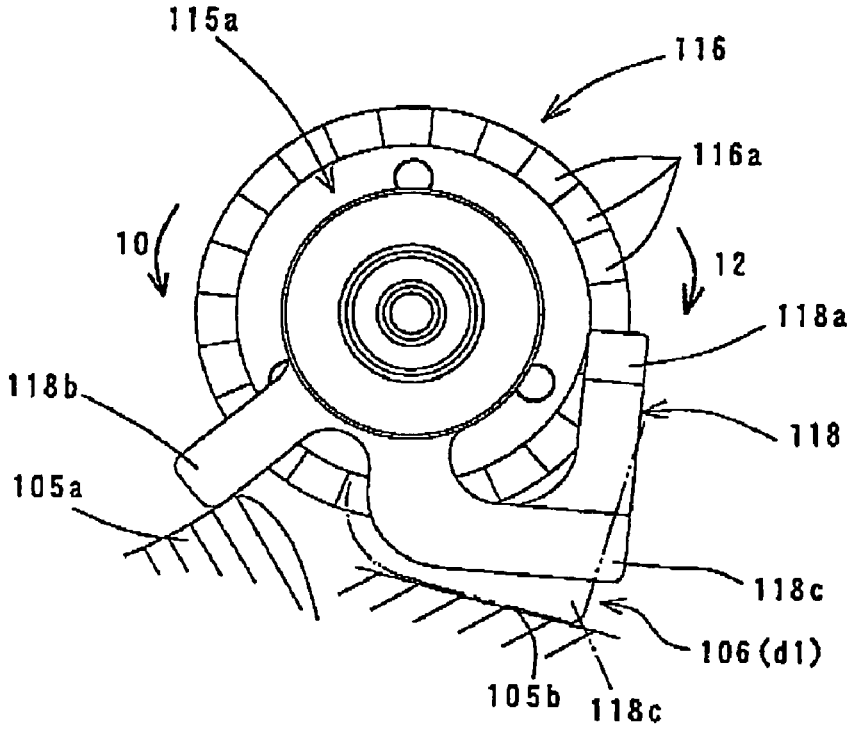
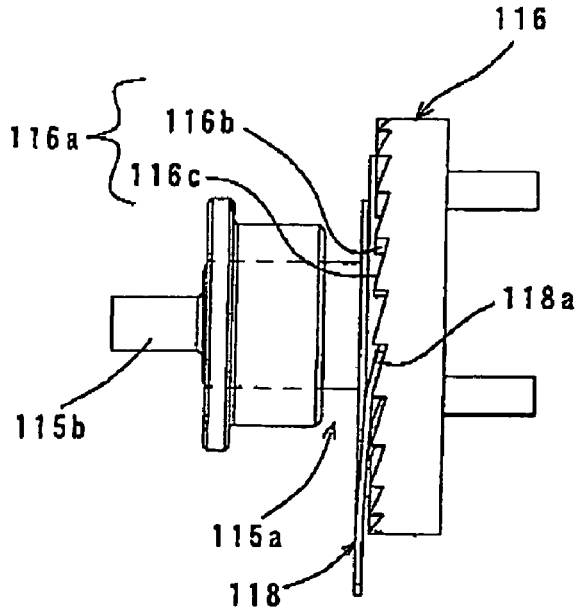
FIG. 35

POWER TOOL

BACKGROUND OF THE INVENTION

1. Field of the Invention

The present invention relates to a power tool that performs a striking operation of driving materials to a workpiece by linearly moving a driving mechanism.

2. Description of the Related Art

Japanese Utility Model Publication No. 2567867 discloses an actuating device (operating device) of a staple driving (striking) machine which utilizes a spring force of a coil spring as a driving force for the driving movement of a driving member in the form of a driver. The known actuating device includes a contact detection arm that is pressed against a workpiece during staple driving operation, a trigger that is depressed by a user's finger, a lever mechanism comprising a plurality of levers that arc actuated by the contact detection arm or the trigger and are coordinated with each other or released from the coordination, and a power switch that is turned on and off by the lever mechanism. When tie contact detection arm is pressed against the workpiece and the trigger is depressed, the power switch is turned on via the lever mechanism and the motor is energized. When the motor is energized, the driver drives in a staple: In the process in which the driver moves toward the initial position after driving movement, the driver returns the power switch from the on position to the off position via the lever mechanism.

In the known acing device this constructed, each time the trigger is depressed once, the driver performs one driving operation and then stopped in the initial position. However, the known actuating device is established by the operation of pressing the contact detection arm against the workpiece and by the operation of depressing the trigger by the users finger. Therefore, further improvement is desired in the operability.

SUMMARY OF THE INVENTION

Accordingly, it is an object of the invention to provide an improvement of the operability in a driving operation using a power tool.

According to the present invention, a representative power tool may include a driving material that is strikingly driven into a workpiece, a driving mechanism that drives the driving material into the workpiece by a linear movement, a motor that actuates the driving mechanism, and an operating device that controls energization and de-energization of the motor. A working stroke of the driving member is defined as a period of time from when the driving member starts driving in one driving material till when preparing for driving in the next driving material is completed. The "power tool" in this invention typically corresponds to a nailing machine or a tucker. The "driving material" in this invention widely includes a straight rod-like material having The operating device includes a trigger switch that is normally biased into an off position (turning-off position) to disable the driving motor from being energized and is turned to an on position (turning-on position) to enable the driving motor to be energized when the trigger switch is depressed by the user. Further, the operating device includes an internal switch that is normally biased into an off position (turning-off position) to disable the driving motor from being energized and is turned to an on position (turning-on position) to enable the driving motor to be energized by interlocking with the depressing operation of the trigger switch. The internal switch is held in the on position for a predetermined period of time in the working stroke and then returned to the off position. The motor is energized when both the trigger switch and the internal switch are turned to the on position, while the motor is de-energized when either one of the switches is returned to the off position. Specifically, when the user depresses the trigger switch, the motor is energized and a driving member performs an operation of driving in a driving material.

The operating device has a first mode and a second mode. In the first mode, when the trigger switch is depressed, the trigger switch is turned to the on position and the internal switch is interlocked with the depressing operation of the trigger switch to be turned to the on position and held in the on position, while the trigger switch is returned to the off position when the trigger switch is released. In the second mode, when the depressing operation of the trigger switch is continued, the trigger switch is held in the on position, and the internal switch is released from the interlock with the trigger switch and is held in the on position for a predetermined period of time in the working stroke and then returned to the off position, while the trigger switch is returned to the off position when the trigger switch is released. The working stroke of the driving member is started when the operating device is put into the first mode by the depressing operation of the trigger switch, and after a predetermined time of period elapses after start of the working stroke, the operating device switches from the first mode to the second mode.

The operating device is put into the first mode when the trigger switch is depressed by the user. Specifically, the trigger switch is turned to the on position to allow the motor to be energize and the internal switch is also turned to the on position to allow the driving motor to be energized by interlocking with the depressing operation of the trigger switch and then held in the on position. As a result, he motor is energized and the working stroke of driving in a driving material by a driving member is started, and after a predetermined time of period elapses after start of the working stroke, the operating device switches from the first mode to the second mode. By such switching from the first mode to the second mode, the trigger switch is held in the on position, while the internal switch is released from the interlock with the trigger switch and is held in the on position for a predetermined period of time in the working stroke and then returned to the off position. As a result, the motor is de-energized. Thus, according to this invention, each time the trigger switch is depressed once, the driving member is caused to perform one driving operation and then stopped. Such movement can be reliably performed only by depressing the trigger switch. Specifically, even during the continued depressing operation of the trigger switch, double driving of the driving member can be reliably prevented. Therefore, compared with the prior art which requires an operation of pressing a contact detection arm against a work-piece and an operation of depressing a trigger, the operability of the operating device can be enhanced.

Further, when the depressing operation of the trigger switch is discontinued halfway through the working stroke of driving in a driving material by a driving member, or when the trigger switch is released halfway through the depressing operation, the trigger switch is returned to the off position. Thus, the motor is de-energized, and the driving operation can be stopped in progress. Further, after such interruption, when the trigger switch is depressed again, the driving motor is energized. Therefore, the once interrupted driving operation of the driving member can be resumed without any problem.

Other objects, features and advantages of the present invention will be readily understood after reading the following detailed description together with the accompanying drawings and the claims.

BRIEF DESCRIPTION OF THE DRAWINGS

FIG. 6 is a plan view showing the operating device, in a state in which the depressing operation of the trigger is started.

FIG. 7 is a front view showing the operating device, in the state in which the depressing operation of the trigger is started.

FIG. 8 is a plan view showing the operating device, in a state in which the trigger is further depressed and a cam disc is allowed to rotate.

FIG. 9 is a front view showing the operating device, in the state in which the trigger is further depressed and the cam disc is allowed to rotate.

FIG. 10 is a plan view showing the operating device, in a state in which the trigger is ether depressed and rotation of the cam disc is started.

FIG. 11 is a front view showing the operating device, in the sa in which the trigger is further depressed and rotation of the cam disc is start.

FIG. 12 is a plan view showing the opening device, in a state in which the trigger is further depressed down to the depressing end.

FIG. 13 is a front view showing the operating device, in the state in which the trigger is further depressed down to the depressing end.

FIG. 14 is a plan view showing the operating device, in a state in which interlock between the trigger and the cam block is released.

FIG. 15 is a front view showing the operating device, in the state in which interlock between the trigger and the cam block is released.

FIG. 16 is a plan view showing the operating device, in a state in which the cam block is placed in a position to hold a second switch in the on-position.

FIG. 17 is a front view showing the operating device, in the state in which the cam block is placed in a position to hold the second switch in the on position.

FIG. 18 is a plan view showing the operating device, in a state in which the cam block is placed in a position to turn off the second switch.

FIG. 19 is a front view showing the operating device, in the state in which the second switch is returned to the off position.

FIG. 20 is a plan view showing the operating device, in a state in which the swing arm moves in an attempt to return to the initial, interlocked position.

FIG. 21 is a front view showing the operating device, in a state in which the swing arm moves in an attempt to return to the initial, interlocked position.

FIG. 34 shows a ratchet wheel 116 and a leaf spring 118 forming a reverse rotation preventing mechanism of a speed reducing mechanism 115 in this embodiment, as viewed from the side of a driving mechanism 117 in FIG. 3.

FIG. 35 is a side view of the ratchet wheel 116 and the leaf spring 18 shown in FIG. 5.

DETAILED DESCRIPTION OF THE INVENTION

Each of the additional features and method steps disclosed above and below may be Utilized separately or in conjunction with other features and method steps to provide and manufacture improved power tools and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
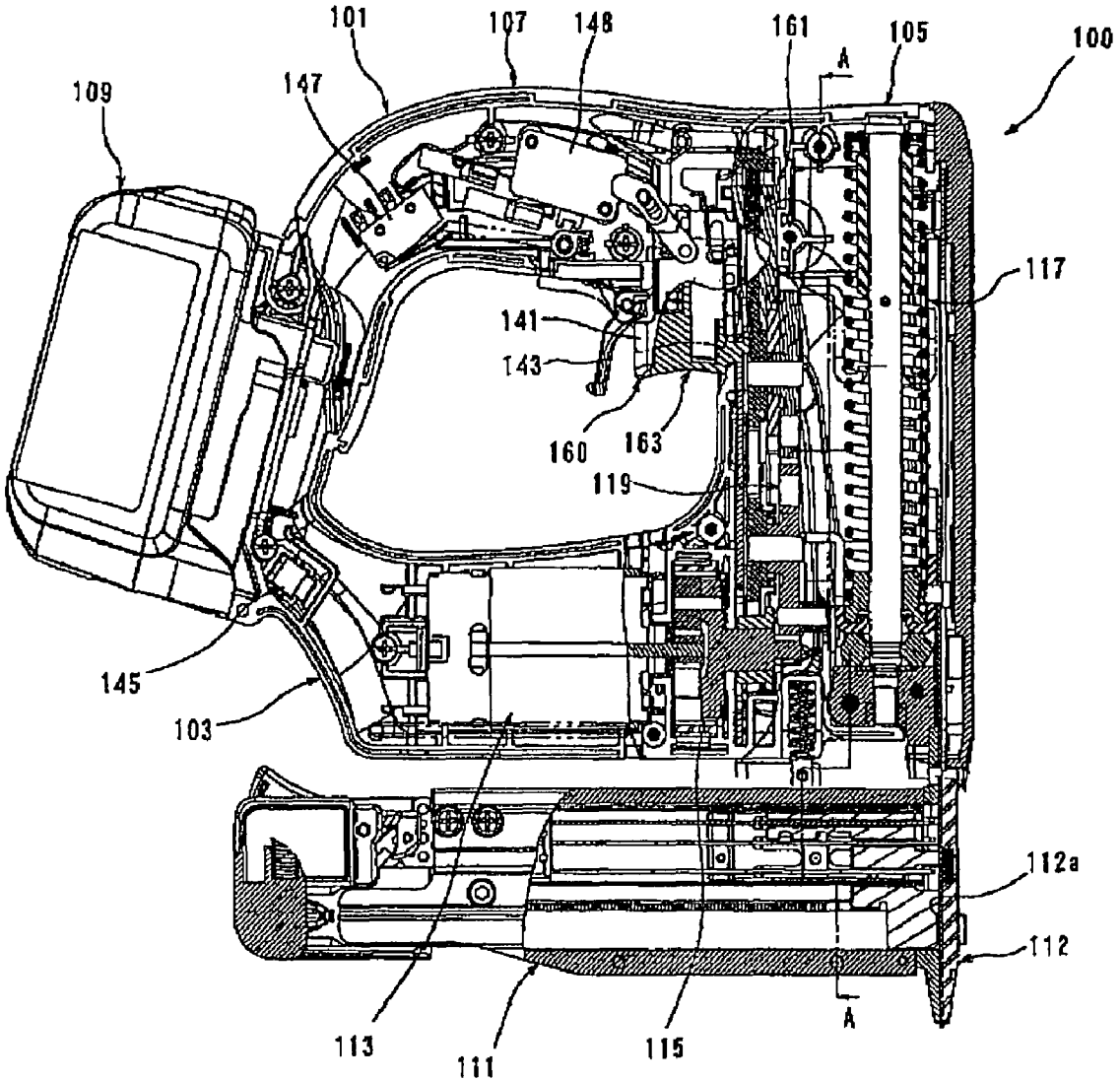
FIG. 1 is a sectional side view, schematically showing an entire battery-powered pin tucker 100 according to an embodiment of the invention.
Figure 2:
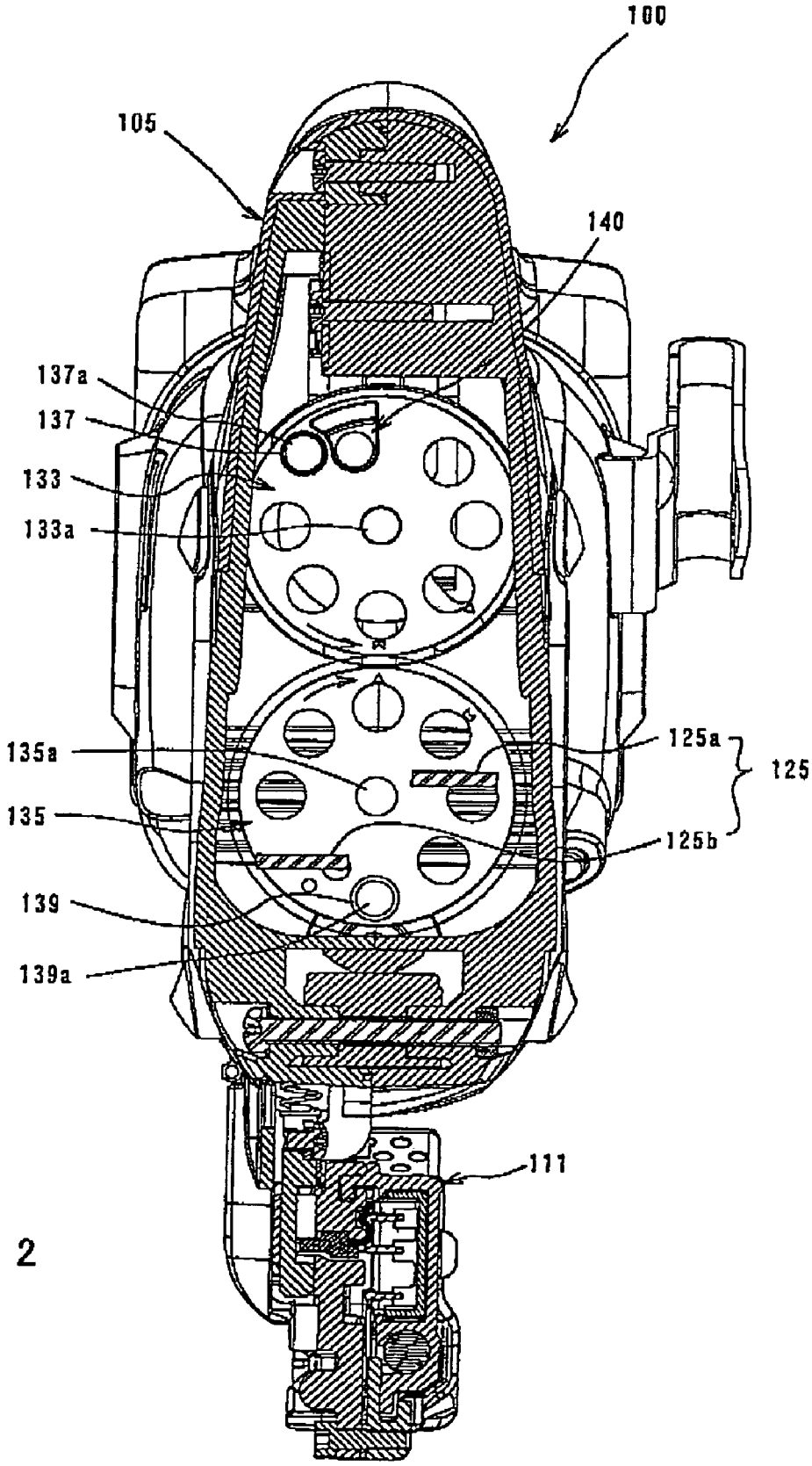
FIG. 2 is a sectional view taken along line A-A in FIG. 1.
Figure 3:
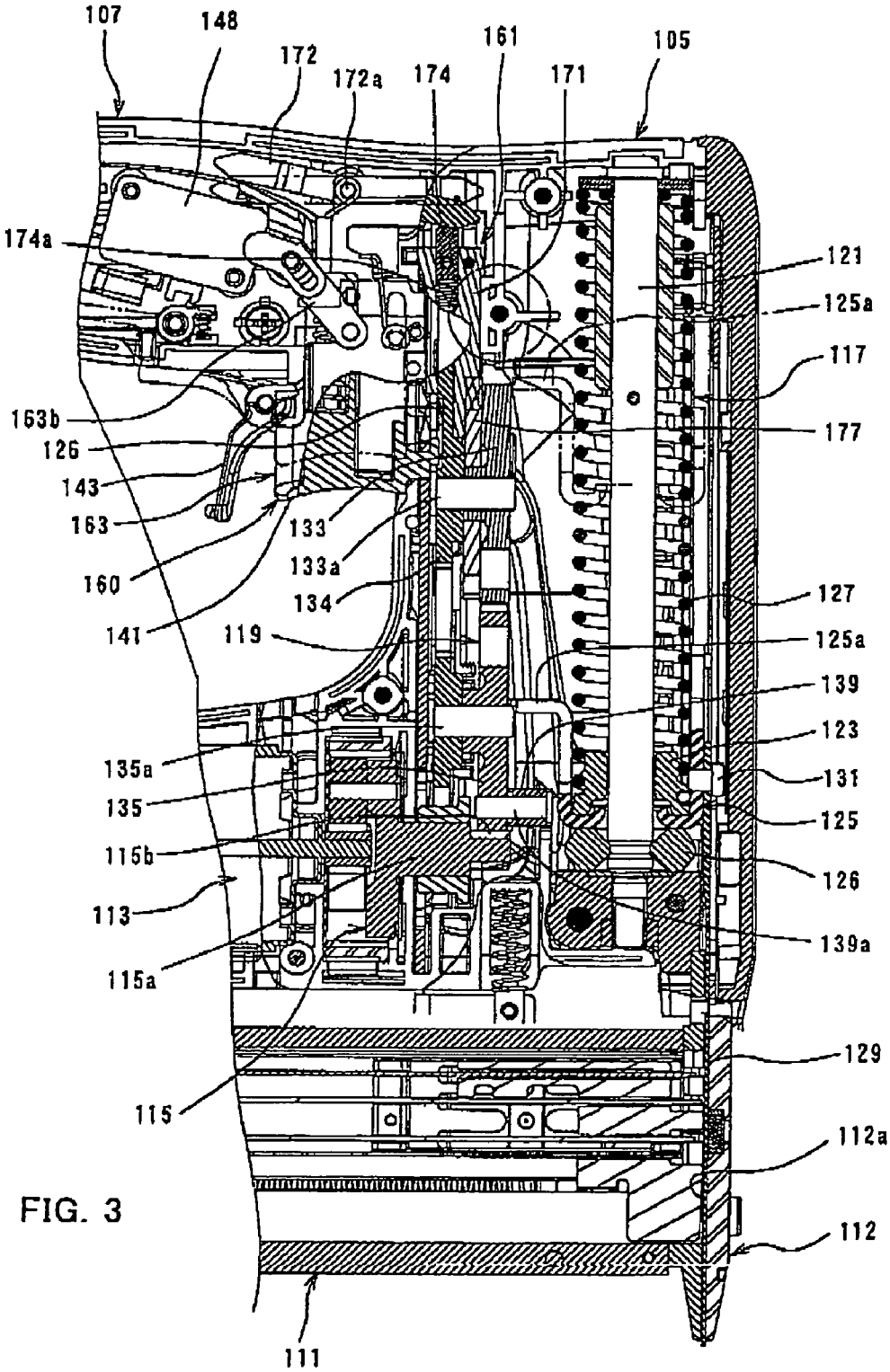
FIG. 3 is an enlarged sectional view of an essential part of the pin tucker 100.

A representative embodiment of the present invention will now be described with reference to FIGS. 1 to 5. FIG. 1 is a sectional side view, schematically showing an entire battery-powered pin tucker 100 as a representative example of a power tool according to the embodiment of the present invention. FIG. 2 is a sectional view taken along line A-A in FIG. 1. FIG. 3 is an enlarged sectional view of an essential part of the pin tucker 100. As shown in FIG. 1, the pin tucker 100 of this embodiment includes a body 101, a battery case 109 tat houses a battery, and a magazine 111 that is loaded with driving materials in the form of pins to be driven into a workpiece.

The body 101 includes a motor housing 103 that houses a driving motor 113, a gear housing 105 that houses a driving mechanism 117 and a hammer drive mechanism 119, and a handgrip 107 that is held by a user. The handgrip 107 is disposed above the motor housing 103. The gear housing 105 is disposed on one horizontal end (on the right side as viewed in FIG. 1) of the motor housing 103 and the handgrip 107, and the battery case 109 is disposed on the other horizontal end thereof. The magazine 111 is designed to feed pins to be driven to the lower end of the gear housing 105 or to a pin injection part 112 connected to the end of the body 101.

As shown in FIG. 3, the driving mechanism 117 includes a rod-like slide guide 121, a hammer 125, a compression coil spring 127 and a driver 129. The slide guide 121 vertically linearly extends and its upper and lower ends are secured to the gear housing 105. The hammer 125 is vertically movably fitted onto the slide guide 121 via a cylindrical slider 123. The compression coil spring 127 exerts a spring force on the hammer 125 to cause downward driving movement of the hammer 125. The driver 129 is moved together with the hammer 125 and applies a striking force to a pin fed to a pin driving port 112*a* of the injection part 112. The driver 129 is a feature that corresponds to the "driving member" according to the present invention. The driver 129 is connected to the hammer 125 by a connecting pin 131. Further, the hammer 125 has upper and lower engagement projections 125*a*, 125*b* that are lifted up by engagement with upper and lower lift rollers 137, 139. The pin and the workpiece are not shown in the drawings.

The compression coil spring 127 in this embodiment is configured to build up the spring force by compression and release the built-up spring force by freely extending. The compression coil wring 127 is a feature that corresponds to the "coil spring" according to this invention. The driver 129 is connected to the hammer 125 by the connecting pin 131. Further, the hammer 125 has an upper engagement projection (the engagement projection 125*a* shown in FIGS. 2 and 3) and a lower engagement projection (the engagement projection 125*b* shown in FIG. 2). The upper engagement projection 125*a* is lifted up by engagement with an upper lift roller (the lift roller 137 shown in FIG. 2). The lower engagement projection 125*b* is lifted up by engagement with a lower lift roller (the lift roller 139 shown in FIGS. 2 and 3). The pin as a driving material comprises a straight rod-like material having a pointed end with or without a head, Further, a safety lever 143 for disabling the depressing operation of the trigger 141 is provided on the handgrip 107. The depressing operation of the trigger 141 is disabled when the safety lever 143 is placed in a locked position shown by a solid line in FIG. 1, while the depressing operation is enabled when the safety lever 143 is placed in a lock released position shown by a phantom line in FIG. 1. Further, a light 145 (see FIG. 1) for illuminating a pin driving region is provided on the body 101. A light illuminating switch 147 is turned on by the safety lever 143. When the safety lever 143 is placed in the locked position, the switch 147 is turned off so that the light 145 goes out.

The rotating output of the driving motor 113 is transmitted to the hammer drive mechanism 119 via a planetary-gear type speed reducing mechanism 115. As shown in FIGS. 2 and 3, the hammer drive mechanism 119 includes upper and lower gears 133, 135 that rotate in opposite directions in a vertical plane in engagement with each other, and the upper and lower lift rollers 137, 139 (see FIG. 2) that lift up the hammer 125 by rotation of the gears 133, 135.

The gears 133, 135 are rotatably mounted on a frame 134 disposed within the gear housing 105, via shafts 133*a*, 135*a* The lift rollers 137, 139 are rotatably mounted to the gears 133, 135 via support shafts 137*a*, 139*a* in a position displaced from the center of rotation of the gears 133, 135. When the gears 133, 135 rotate, the lift rollers 137, 139 revolve around the center of rotation of the gears 133, 135 along an arc. The amount of displacement of the support shaft 137*a* of the upper lift roller 137 is equal to the amount of displacement of the support shaft 139*a* of the lower lift roller 139. The lower gear 135 engages with a driving gear 115*b* formed on an output shaft 115*a* of the speed reducing mechanism 115 and is rotated in a predetermined reduction gear ratio. The gear ratio of the lower gear 135 to the upper gear 133 stands at one to one. Further, the upper and lower lift rollers 137, 139 are disposed with a phase difference of approximately 180°. The initial position of the upper and lower lift rollers 137, 139 is defined here as the state in which the lift rollers 137, 139 are in the remotest position from each other, or in which the lower lift roller 139 is located on the lower side of the lower gear 135 and the upper lift roller 137 is located on the upper side of the upper gear 133 (as shown in FIG. 2).

When the driving motor 113 is energized and the upper and lower gears 133, 135 are caused to rotate in the direction of the arrow in FIG. 2, the lower lift roller 139 engages from below with the lower engagement projection 125*b* of the hammer 125 located at the bottom dead center and moves upward along an arc, and thereby lifts up the hammer 125 by vertical components of the circular arc movement. When the amount of lift of the hammer 125 by the lower lift roller 137 reaches near the maximum the upper lift roller 137 in turn engages from below with the upper engagement projection 125*a* of the hammer 125 and moves upward along an arc, and thereby lifts up the hammer 125. In this manner, the hammer 125 is moved upward from the bottom dead center (the position of completion of pin driving, or the initial position) toward the top dead center via the relay of the upper and lower lift rollers 137, 139. The compression coil spring 127 is compressed by this upward movement of the hammer 125 and builds up the spring force. The upper engagement projection 125*a* of the hammer 125 is further passed over from the upper lift roller 137 to a cam 140 in the region of the top dead center. When the driver 129 is lifted upward together with the hammer 125, a pin in the magazine 111 is fed to the pin injection port 112*a* of the injection part 112. Thereafter, upon disengagement from the cam 140, the hammer 125 is caused to perform a downward driving movement by the spring force of the compression coil spring 127. Thus, the pin fed to the pin injection port 112*a* of the injection part 112 is driven into the workpiece by the driver 129 moving downward through the pin injection port 112*a*. After completion of the driving movement, the hammer 125 is held at the bottom dead center by contact with a stopper 126.

After disengagement of the cam 140 and the hammer 125, in order to prepare for the next hammer lifting movement, the gears 133, 135 continue to further rotate until they return to and stop at the initial position in which the upper and lower lift rollers 137, 139 are remotest from each other. Specifically, the period of time from when the lower lift roller 139 is driven and starts upward lifting movement of the hammer 125 together with the driver 129 in engagement with the hammer 125 till when the lower lift roller 139 returns to the initial position and prepares for the next hammer lifting movement, corresponds to the "working stroke" according to this invention and represents one turn of each of the gears 133, 135.

An operating device 160 for controlling energization and de-energization of the driving motor 113 will now be described in detail with reference to FIGS. 4 to 32. First, the construction of the operating device 160 will be described with reference to FIGS. 4, 5 and 22. The operating device 160 includes a trigger switch 163 that is turned on by depressing operation of the user, an internal switch 161 that is turned on by interlocking with the depressing operation of the trigger switch 163, and a cam disc 177 that controls a subsequent once or off-state of the on-state internal switch 161. The cam disc 177 is a feature that corresponds to the "control member" according to this invention.

The trigger switch 163 is arranged on the handgrip 107 and includes a trigger 141 that is linearly depressed by the user, a lost switch 148 (see FIGS. 1 and 3) and a swing arm 164. The first switch 148 is normally biased by a biasing spring (not shown) into the off position to disable the driving motor 113 from being energized. When the trigger 141 is depressed, the first switch 148 is turned to the on position to enable the driving motor 113 to be energized. The swing arm 164 interlocks the depressing operation of the trigger 141 to the internal switch 161, The trigger 141 and the swing arm 164 are features that correspond to the "finger operating member" and the "interlocking member", respectively, according to this invention. The trigger 141 is linearly movably mounted to a guide plate 168 fixedly mounted to a frame 134. The trigger 141 is biased by a compression coil spring 165 in a direction opposite to the depressing direction and is normally held in a pre-operational or released position. When the trigger 141 is depressed, the first switch 148 is turned on via a lever 163*b* (see FIG. 3). The swing arm 164 is connected to the trigger 141 via a shaft 163*a* and can rotate in a direction crossing the depressing direction of the trigger 141. When the trigger 141 is depressed, the swing arm 164 is switched between an interlocked position (shown in FIG. 5) in which it is interlocked with a cam block 171 of the internal switch 161 which will be described below and a interlock released position (shown in FIG. 15) in which such interlock is released. The interlocked position and the interlock released position correspond to the "operating position" and the "non-operating position", respectively, according to this invention The internal switch 161 includes the cam block 171 that linearly moves by interlocking with the depressing operation of the trigger 141, a switch arm 172 that is rotated by the cam block 171, and a second switch 173. The second switch 173 is normally biased by a biasing spring (not shown) into the off position to disable the driving motor 113 from being energized. When the switch arm 172 is rotated, the second switch 173 is turned to the on position to enable the driving motor 113 to be energized. The cam block 171 is a feature that corresponds to the "operating member" according to this invention. The cam block 171 is mounted to the frame 134 such that the cam block 171 can linearly move in the same direction as the depressing direction of the trigger 141. The cam block 171 has an engagement portion 171*a* that faces the swing arm 164 located in the interlocked position. When the trigger 141 is depressed, the swing arm 164 moves in the depressing direction together with the trigger 141 and an end surface 164*a* of the swing arm 164 comes into surface contact with the engagement portion 171*a* The engagement portion 171*a* is then pushed in a surface contacting manner. Specifically, the cam block 171 is caused to move linearly by interlocking with the depressing operation of the trigger 141 and pushes one end of the switch arm 172 via a push pin 174. Thus, the switch arm 172 swings on a shaft 172*a* and turns on the second switch 173. The switch arm 172 is biased by a first torsion spring 175 in the direction of turning off the second switch 173.

Further, a second torsion spring 166 is provided on the swing arm 164 (see FIGS. 31 and 32), and a third torsion spring 167 is provided on the trigger 141. The second torsion spring 166 corresponds to the "elastic member" and the "second spring member" and the third torsion spring 167 corresponds to the "fist spring member" according to this invention. The second torsion spring 166 has one leg 166*a* engaged with the swing arm 164 and the other leg 166*b* held free. When the free leg 166*b* is rotated on the shaft 163*a*, the swing an 164 is rotated via the second torsion spring 166. The end of the free leg 166*b* of the second torsion spring 166 is bent about 90°. The third torsion spring 167 has one leg 167*a* engaged with the trigger 141 and the other leg 167*b* engaged with the free leg 166*b* (the bent portion) of the second torsion spring 166. Thus, the biasing force of the third torsion spring 167 is normally applied in a direction that rotates the swing arm 164 from the interlocked position to the interlock released position via the second torsion spring 166. This biasing force is received by the guide plate 168.

The guide plate 168 has a guide surface 169 that is engaged with the free leg 166*b* of the second torsion spring 166. The guide surface 169 includes a flat surface portion 169*a* and an inclined surface portion 169*b*. The flat surface portion 169*a* extends in a direction parallel to the direction of operation of the trigger 141 or the direction of movement of the cam block 171. The inclined surface portion 169*b* contiguously extends from the flat surface portion 169*a*. When the trigger 141 is in the released position, the flat surface portion 169*a* receives the free leg 166*b* of the second torsion spring 166, so that the swing arm 164 is held in the interlocked position. The guide plate 168 corresponds to the "guide member" according to this invention. When the trigger 141 is depressed, the swing arm 164 moves together with the trigger 141 and the end surface 164*a* of the swing arm 164 comes into surface contact with the engagement portion 171*a* of the cam block 171. Thus, the swing arm 164 is pushed in the direction that turns on the second switch 173. By this movement, the free leg 166*b* of the second torsion spring 166 passes over the flat surface portion 169*a* of the guide surface 169 and moves onto the inclined surface portion l 69*b*. At this time, the swing arm 164 is held in the interlocked position against the biasing force of the third torsion spring 167 by the frictional force of the contact surfaces between the swing arm 164 and the cam block 171. Therefore, the free leg 166*b* of the second torsion spring 166 is located in a position (space) in which the free leg 166*b* is disengaged from the inclined surface 169*b* (see FIG. 9). Thereafter, the cam block 171 is further moved in a throwing direction (trigger depressing direction) that turns on the second switch 173 by the cam disc which will be described below. The swing arm 164 is then disengaged from the cam block 171. At this time, the Swing arm 164 is rotated from the interlocked position to the interlock released position by the biasing force of the third torsion spring cam 167 (see FIG. 15).

When the trigger 141 is released and returned to the released position, the swing arm 164 in the interlock released position is returned to the initial position or the interlocked position after passing underneath the cam block 171 if the cam block 171 is returned to the initial position earlier than the trigger 141, which will be described below.

As mentioned above, in the operating device 160 according to this embodiment, when the trigger 141 is depressed, the cam block 171 is interlocked with the trigger 141 via the swing arm 164, so that the first switch 148 is turned on by the trigger 141. At the same time, the second switch 173 is turned on via the cam block 171, the push pin 174 and the switch arm 172. When both the first and second switches 148 and 173 are turned on, the motor is energized, while either one of the first and second switches 148 and 173 is turned off, the motor is de-energized. The first and second switches 148 and 173 are disposed in alignment with each other as seen in FIGS. 1 and 3. Therefore, the second switch 173 is not shown in FIGS. 1 and 3.

Figure 22:
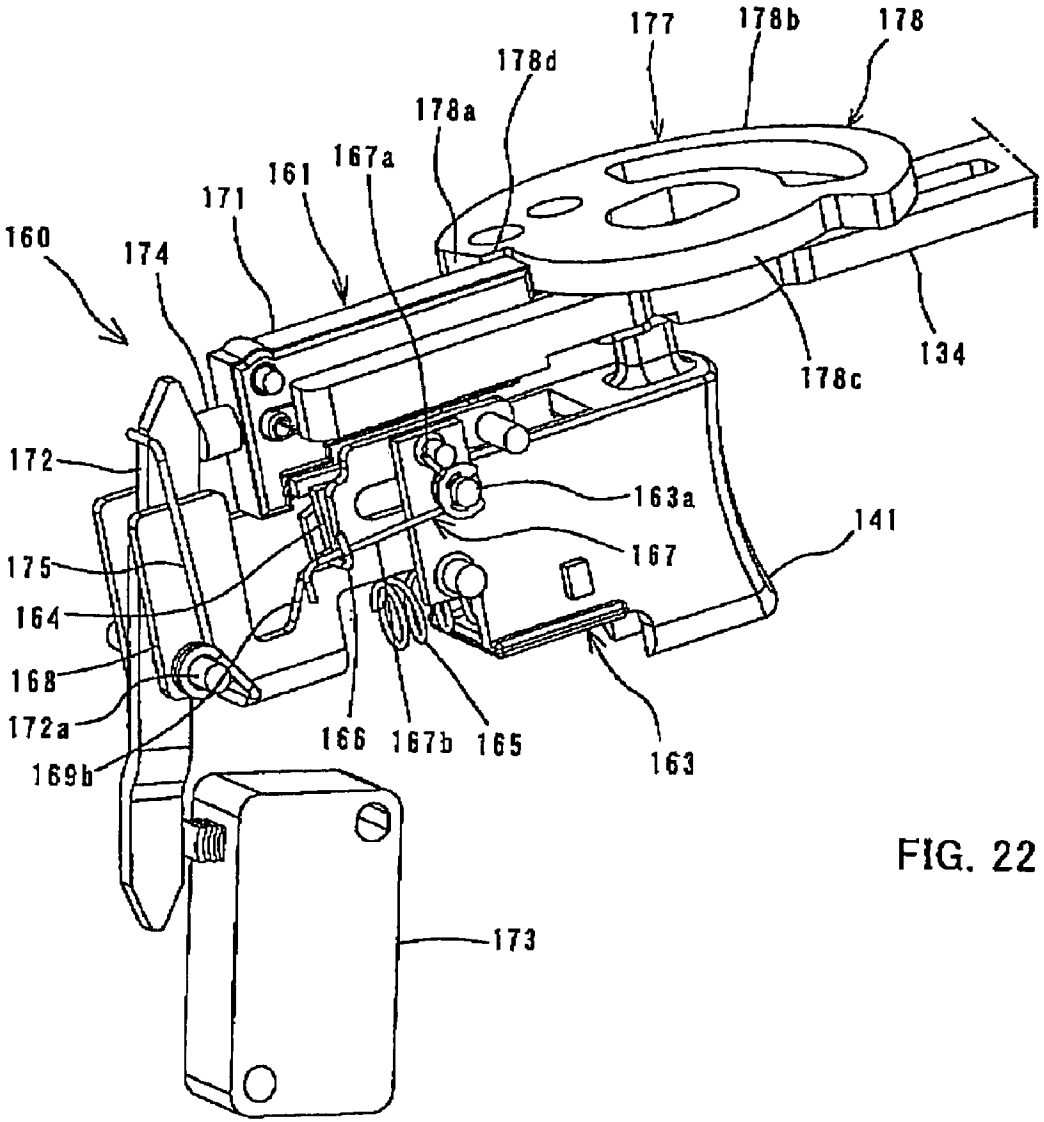
FIG. 22 is a perspective view showing the operating device, in a state in which the trigger is not yet depressed.

Next, the cam disc 177 for controlling the cam block 171 will now be described with reference to FIGS. 4 and 22. The cam disc 177 is mounted in such a manner as to rotate together with the upper gear 133 of the above-described hammer drive mechanism 119 (see FIG. 3). The cam disc 177 has a circumferential surface designed as a cam face 178 and is disposed such that the end of the cam block 171 faces the cam face 178. The cam face 178 of the cam disc 177 includes a rake region 178*a*, a large-diameter region 178*b* and a small-diameter region 178*c* in the circumferential direction. When the trigger 141 is depressed and the cam block 171 is moved in the throwing direction that turns on the second switch 173, the rake region 178*a* engages with the end of the cam block 171. The rake region 178*a* then further moves the cam block 171 in the throwing direction and thereby releases the interlock between the cam block 171 and the swing arm 164. The large-diameter region 178*b* moves while being held in engagement with the end of the cam block 171 and thereby holds the second switch 173 in the on position. The small-diameter region 178*c* disengages from the end of the cam block 171 and allows the second switch 173 to be returned to the off position. The rake region 178*a*, the large-diameter region 178*b* and the small-diameter region 178*c* are features that correspond to the "interlock released region", the "on-state continuation region" and the "off-state return region", respectively, according to this invention.

In order to avoid excessive movement of the switch arm 172 when the cam block 171 is further moved in the throwing direction by the rake region 178*a*, the push pin 174 disposed between the cam block 171 and the switch arm 172 is designed to be movable in the same direction as the Owing direction with respect to the cam block 171. Further, the push pin 174 is held in contact with the switch arm 172 by the biasing force of a biasing spring 174*a* Specifically, when the cam block 171 is moved in the throwing direction by the rake region 178*a*, the push pin 174 absorbs the movement of the cam block 171 by moving with respect to the cam block 171.

The rake region 178*a* is provided between the large-diameter region 178*b* and the small-diameter region 178*c* and comprises an inclined surface extending linearly from the small-diameter region 178*c* to the large-diameter region 178*b*. The large-diameter region 178*b* and the small-diameter region 178*c* each comprise a surface of a circular arc shape defined on the axis of rotation of the cam disc 177. Further, the cam disc 177 has a stopper surface 178*d* on the boundary between the small diameter region 178*c* and the rake region 178*a* The stopper surface 178*d* contacts the side surface of the end of the cam block 171 and thereby prevents the cain disc 177 from rotating beyond a specified position (overrunning). The initial position of the cam disc 177 is the position in which the end of the cam block 171 is placed on the end of the small-diameter region 178*c* on the side of the rake region 178*a* or is in contact with or adjacent to the stopper surface 178*d*. The rake region 178*a*, the large-diameter region 178*b* and the small-diameter region 178*c* face the cam block 171 in this order during rotation of the cam disc 177.

Figure 4:
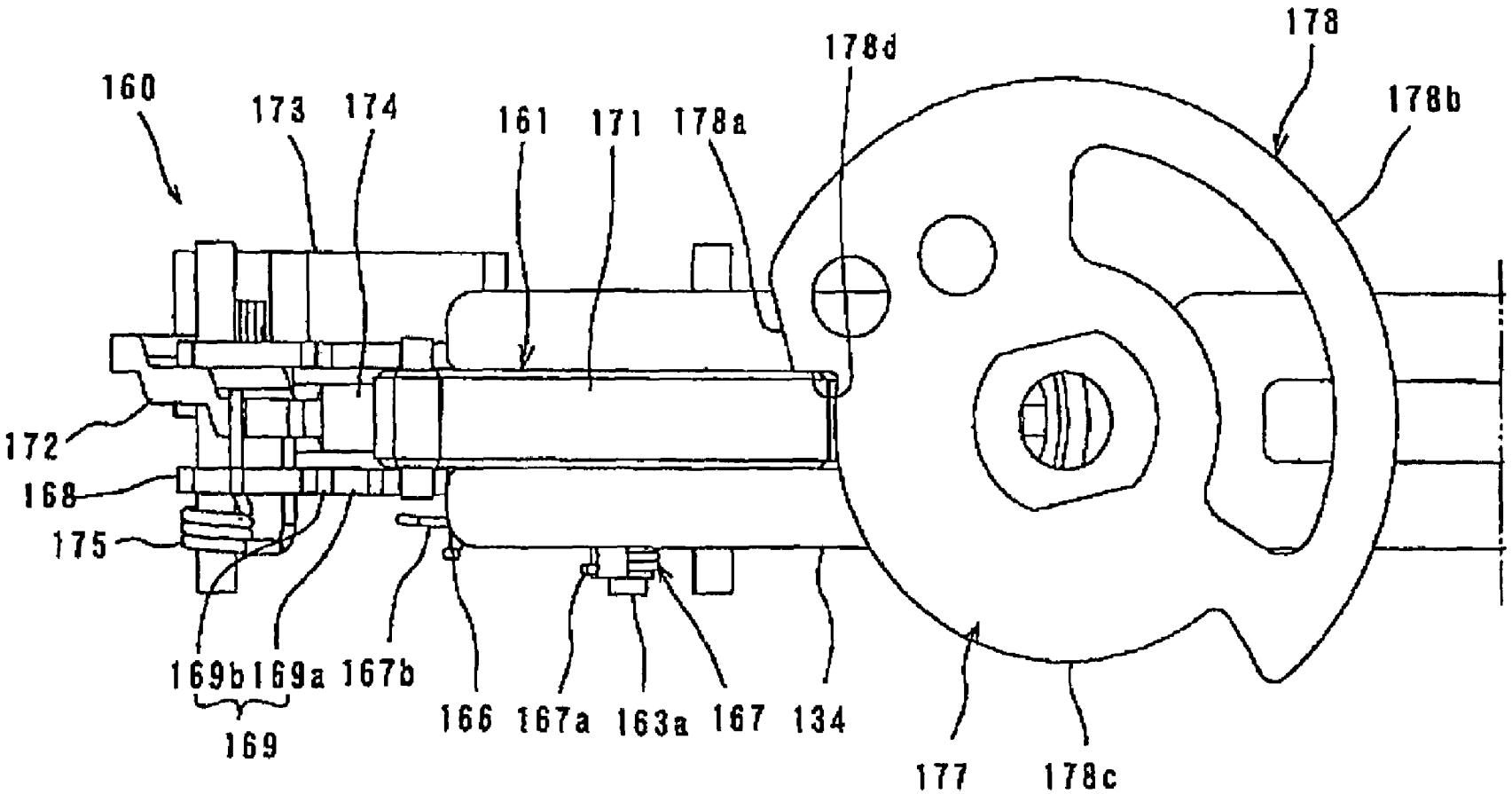
FIG. 4 is a plan view showing an operating device, in an initial state in which a trigger is not yet depressed.

Further, as shown in FIG. 4, the angular range of the small-diameter region 178*c* extends over more than 90° of the perimeter of the cam disc 177, in order to utilize this region as a braking region for braking the driving motor 113 after the second switch is returned to the off position and the driving motor 113 is de-energized. Specifically, the small diameter region 178*c* has the braking region.

Further, a safety lever 143 for disabling the depressing operation of the trigger 141 is provided on the handgrip 107. The depressing operation of the trigger 141 is disabled when the safety lever 143 is placed in a locked position shown by a solid line in FIG. 1, while the depressing operation is enabled when the safety lever 143 is placed in a lock released position shown by a phantom line in FIG. 1. Further, a light 145 (see FIG. 1) for illuminating a pin driving region is provided on the body 101. A light illuminating switch 147 is turned on by the safety lever 143. When the safety lever 143 is placed in the locked position, the switch 147 is turned off so that the light 145 goes out.

Figure 5:
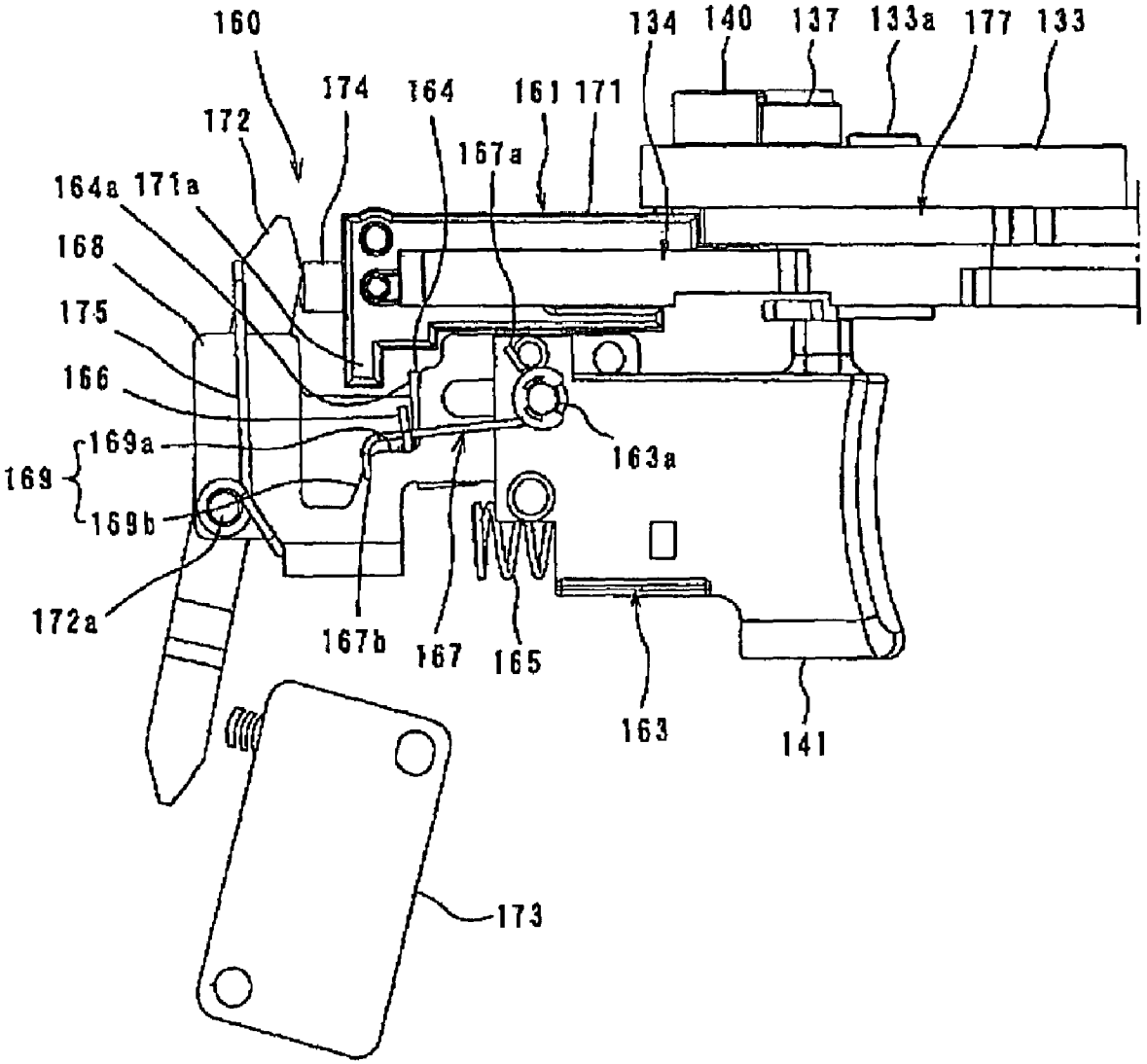
FIG. 5 is a front view showing the operating device, in the initial state in which the trigger is not yet depressed.

Then, an operation of the pin tucker 100 will now be explained with reference to FIGS. 4 to 30, mainly with regard to the operating device 160. FIGS. 4, 5 and 22 show the initial state in which the operating device 160 is not yet operated by the user. In the initial stat, the swing arm 164 is in the interlocked position and the end sure 164*a* of the swing arm 164 faces the engagement portion 171*a* of the cam block 171 with a predetermined spacing therebetween. Further, the end of the cam block 171 is located at the end of the small-diameter region 178*c* of the cam disc 177. Both the first and second switches 148 and 173 are in the off position and the driving motor 113 is at a stop. Further, the driver 129 is located at the bottom dead center (see FIG. 2).

Figure 23:
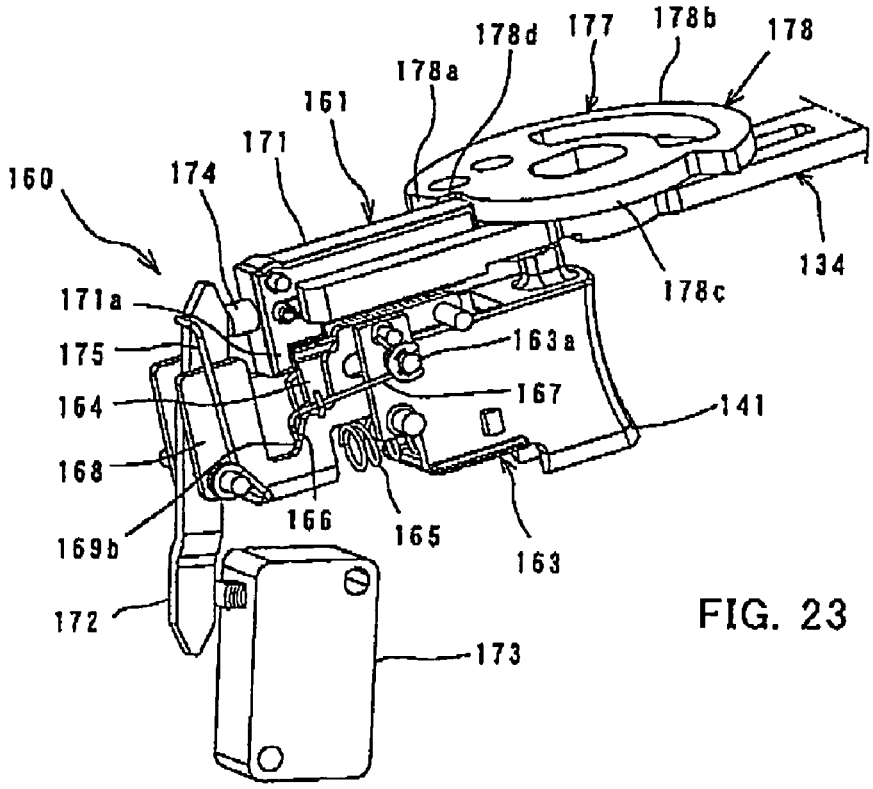
FIG. 23 is a perspective view showing the operating device, in the state in which the depressing operation of the trigger is started.
Figure 24:
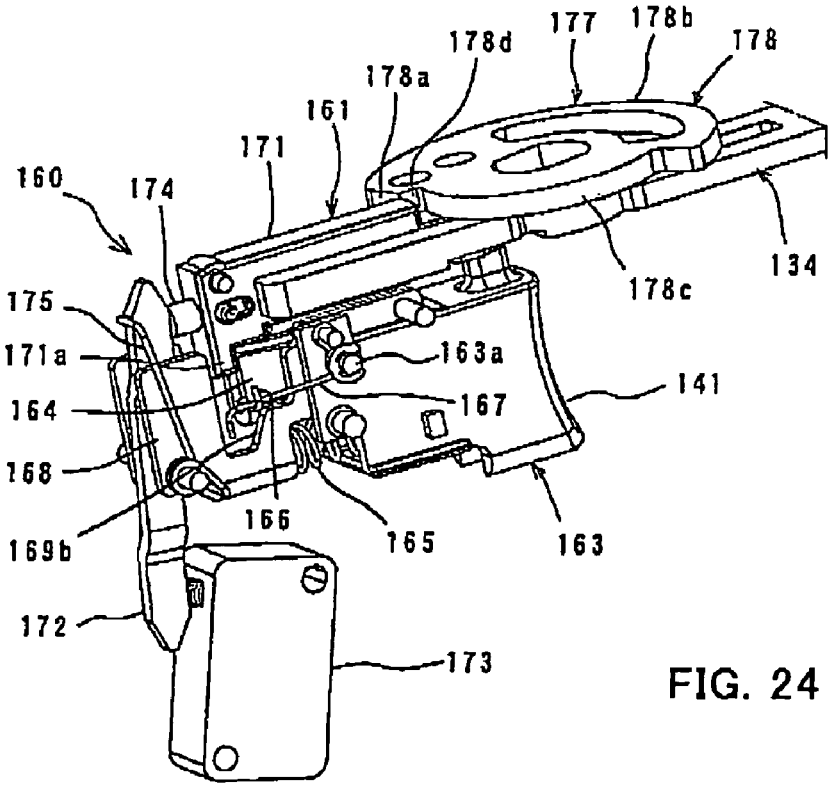
FIG. 24 is a perspective view showing the operating device, in the state in which the trigger is further depressed and the cam disc is allowed to rotate.

FIGS. 6, 7 and 23 show the state in which the depressing operation of the trigger 141 is started by the user. In this state, the end surface 164*a* of the swing arm 164 is in surface contact with the engagement portion 171*a* of the cam block 171. FIGS. 8, 9 and 24 show the state in which the trigger 141 is further depressed and the cam block 171 is pushed by the swing arm 164 moving together with the trigger 141. Specifically, the cam block 171 is moved to a position (contact avoidance position) in which the cam block 171 is disengaged from the stopper surface 178*d* of the cam disc 177, so that the cam disc 177 is allowed to rotate. Immediately thereafter, the first and second switches 148 and 173 are turned on. Further, the free leg 166*b* of the second torsion spring 166 on the swing arm 164 passes over the flat surface portion 169*a* of the guide surface 169. However, the swing arm 164 is held in the interlocked position against the biasing force of the third torsion spring 167 by the frictional force of the contact surfaces between the swing arm 164 and the engagement portion 171*a* of the cam block 171.

Figure 25:
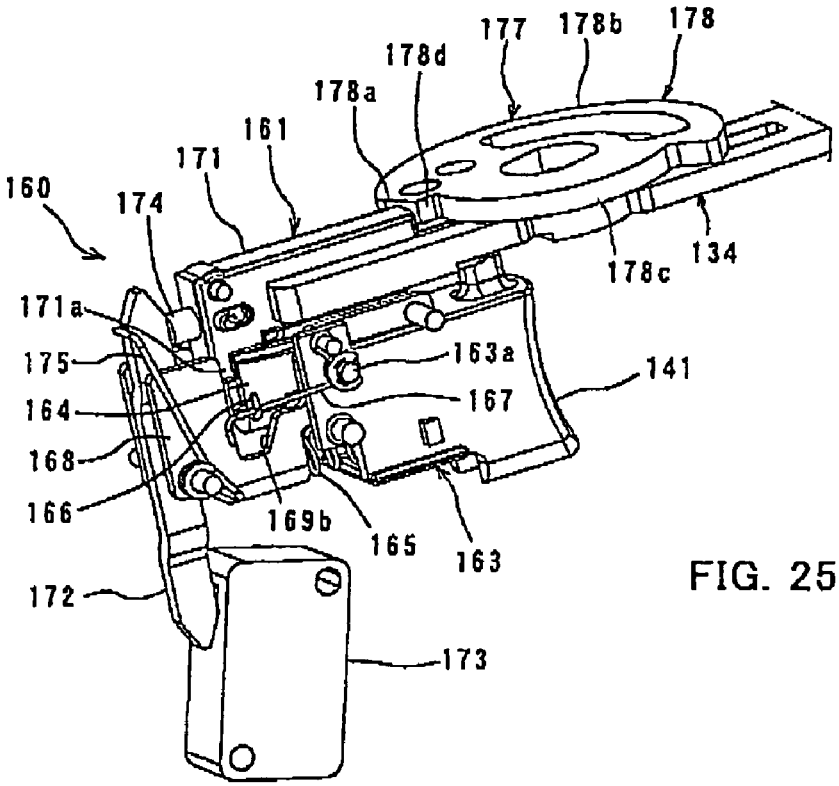
FIG. 25 is a perspective view showing the operating device, in the state in which the trigger is further depressed and rotation of the cam disc is started.

FIGS. 10, 11 and 25 show the state in which the trigger 141 is further depressed and the first switch 148 is turned on via the lever 163*b* and at the same time the second switch 173 is turned on via the cam block 171, the push pin 174 and the switch arm 172, so that the driving motor 113 is energized. When the driving motor 113 is energized, as mentioned above, the gears 133, 135 of the hammer drive mechanism 119 are driven via the speed reducing mechanism 115 and lifting of the hammer 125 starts. Specifically, the driver 129 starts pin driving operation. Further, when the gears 133, 135 are driven, the cam disc 177 starts rotating counterclockwise as viewed in the drawings and moves the cam block 171 in the throwing direction via the rake region 178*a*.

Figure 26:
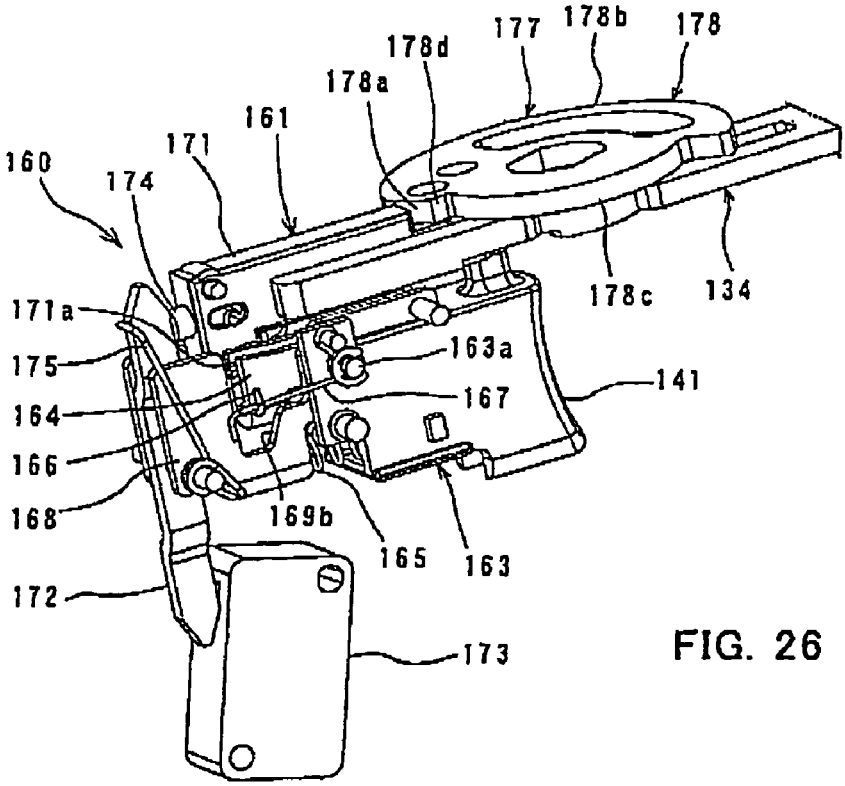
FIG. 26 is a perspective view showing the operating device, in the state in which the trigger is further depressed down to the depressing end.
Figure 27:
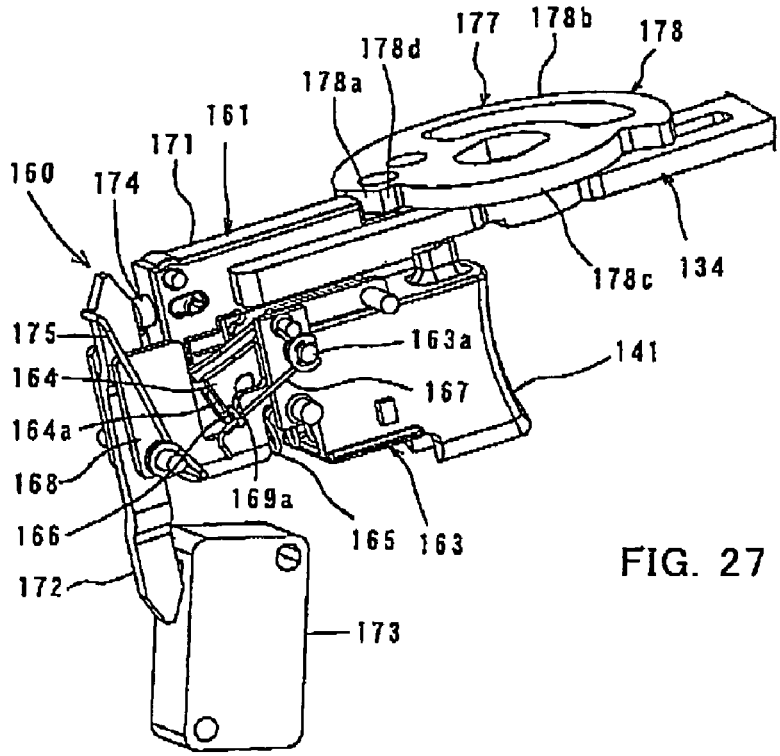
FIG. 27 is a perspective view showing the operating device, in the state in which interlock between the trigger and the cam block is released.

FIGS. 12, 13 and 26 show the state in which the trigger 141 is further depressed down to the depressing end and the cam block 171 is flintier moved in the throwing direction by the rake region 178*a* of the can disc 177. After the trigger has reached the depressing end, the cam block 171 is further moved in the throwing direction by the rake region 178*a* of the cam disc 177. Thus, the engagement portion 171*a* of the cam block 171 is disengaged from the end surface 164*a* of the swing arm 164, so that the frictional force between the contact surfaces ceases to exist. As a result, the swing arm 164 is allowed to rotate from the interlocked position to the interlock released position by the biasing force of the third torsion spring 167. This state is shown in FIGS. 14, 15 and 27.

Figure 28:
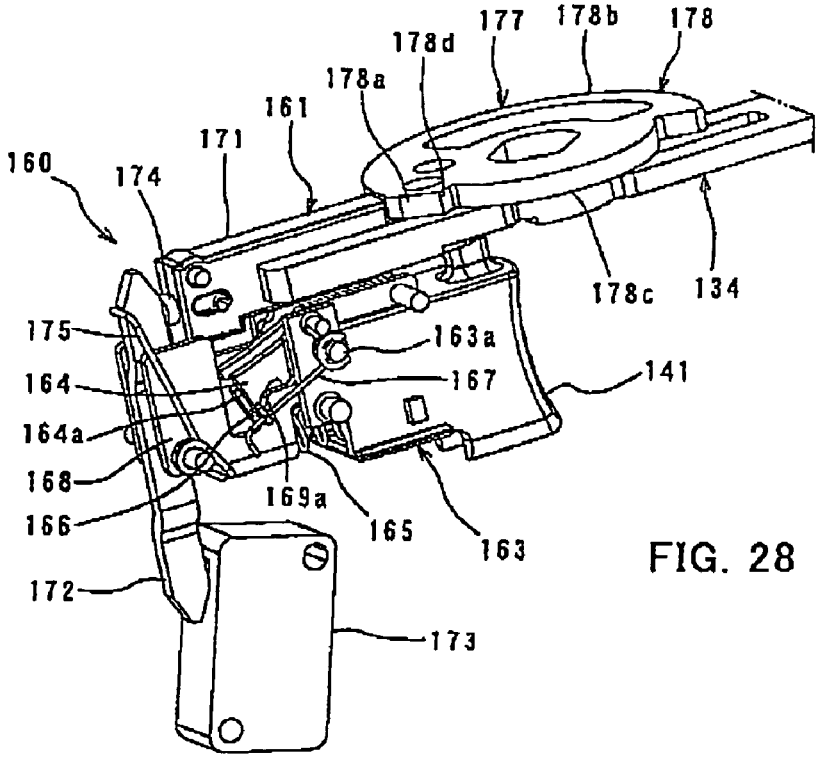
FIG. 28 is a perspective view showing the operating device, in the state in which the cam block is placed in a position to hold the second switch in the on position.

The cam disc 177 continues to rotate and the end of the cam block 171 goes on the large-diameter portion 178*b* of the cam disc 177. Thus, the second switch 173 is held in the on position. Further, the first switch 148 that has been turned on by depressing the trigger 141 is also held in the on position. Therefore, the driving motor 113 is also held running This state is shown in FIGS. 16, 17 and 28. The end of the cam block 171 then moves with respect to the large-diameter portion 178*b* of the cam disc 177 while being held in engagement therewith. In this process, the driver 129 performs a pin driving movement. Specifically, the hammer 125 is moved up to the top dead center via the lift rollers 137, 139 of the hammer drive mechanism 119 and the cam 140, and then the hammer 125 is disengaged from the cam 140. The driver 129 then performs a downward driving movement together with the disengaged hammer 125 by the built-up spring force of the compression coil spring 127. Thus, the driver 128 drives a pin into the workpiece. After completion of the driving movement, the hammer 125 is held at the bottom dead center by contact with the stopper 126.

Figure 29:
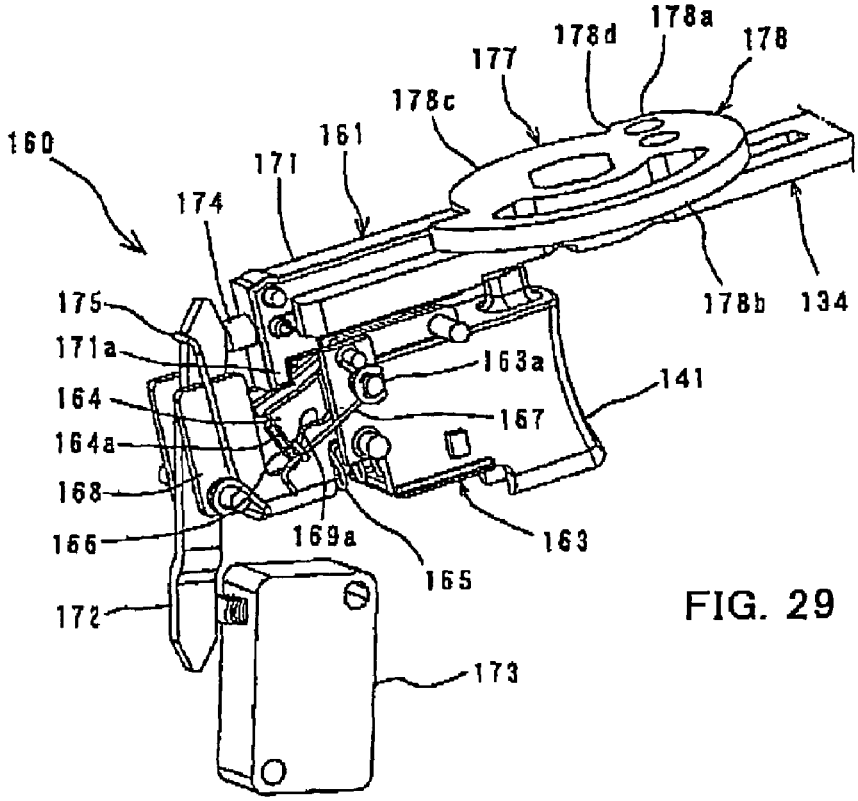
FIG. 29 is a perspective view showing the operating device, in the state in which the second switch is returned to the off position.
Figure 30:
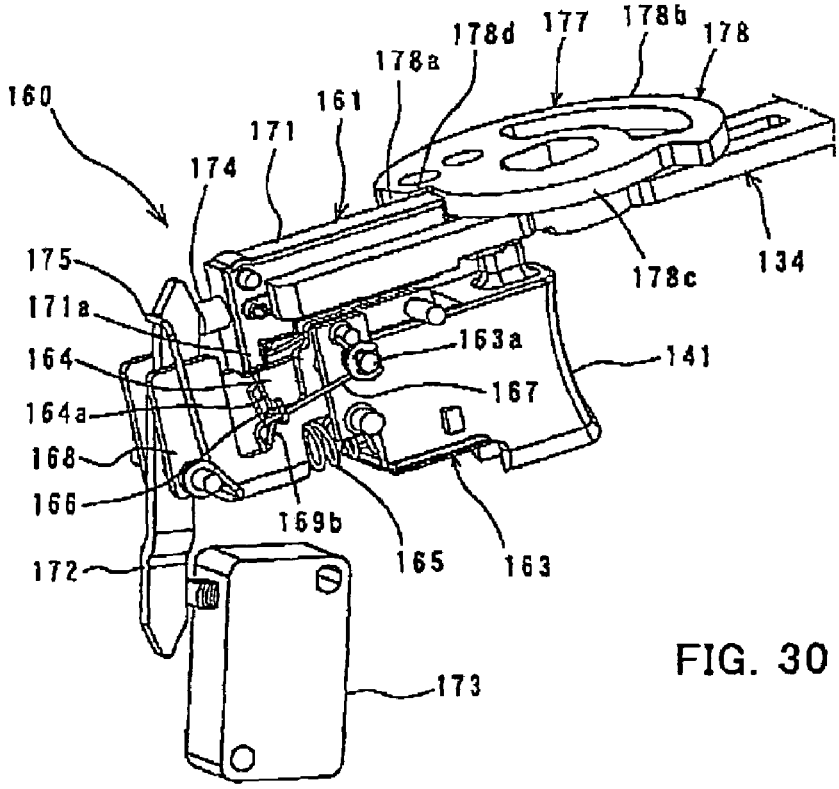
FIG. 30 is a perspective view showing the operating device, in the state in which the swing arm moves in an attempt to return to the initial, interlocked position.
Figure 31:
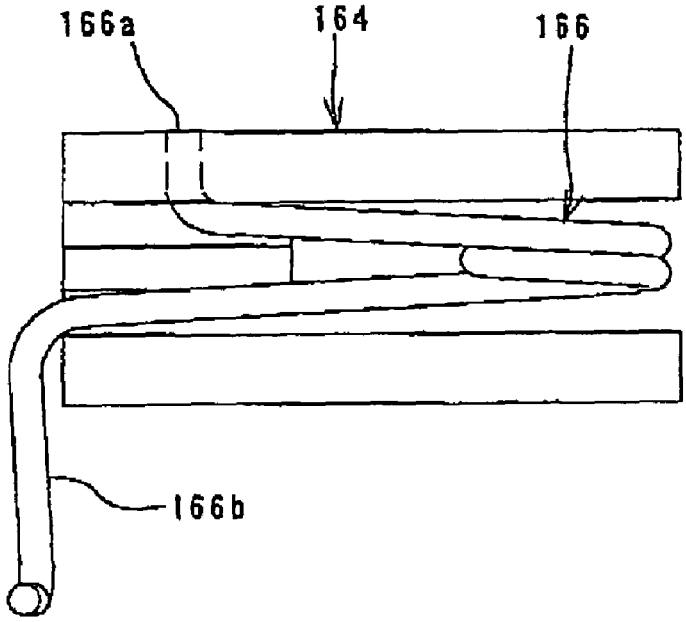
FIG. 31 is a plan view showing the swing arm.
Figure 32:
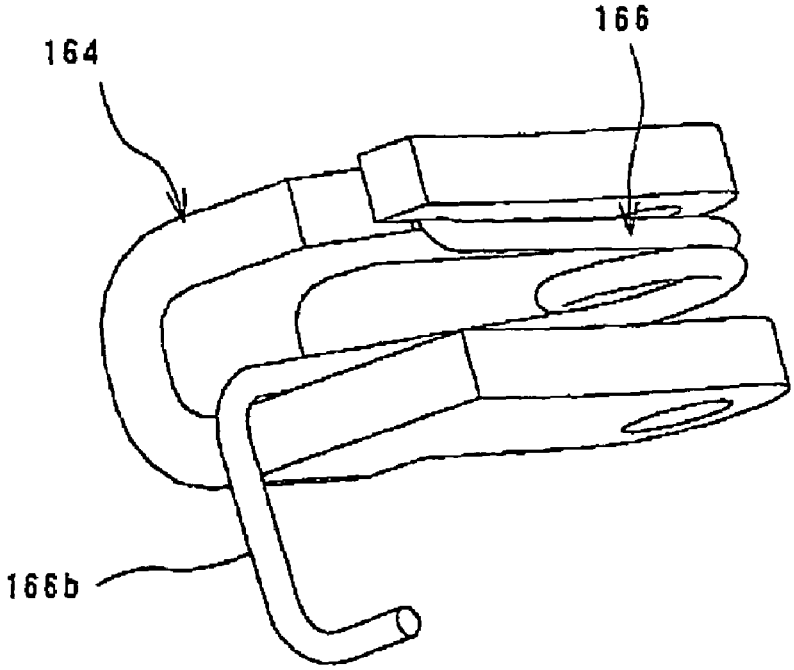
FIG. 32 is a perspective view showing the swing arm.
Figure 33:
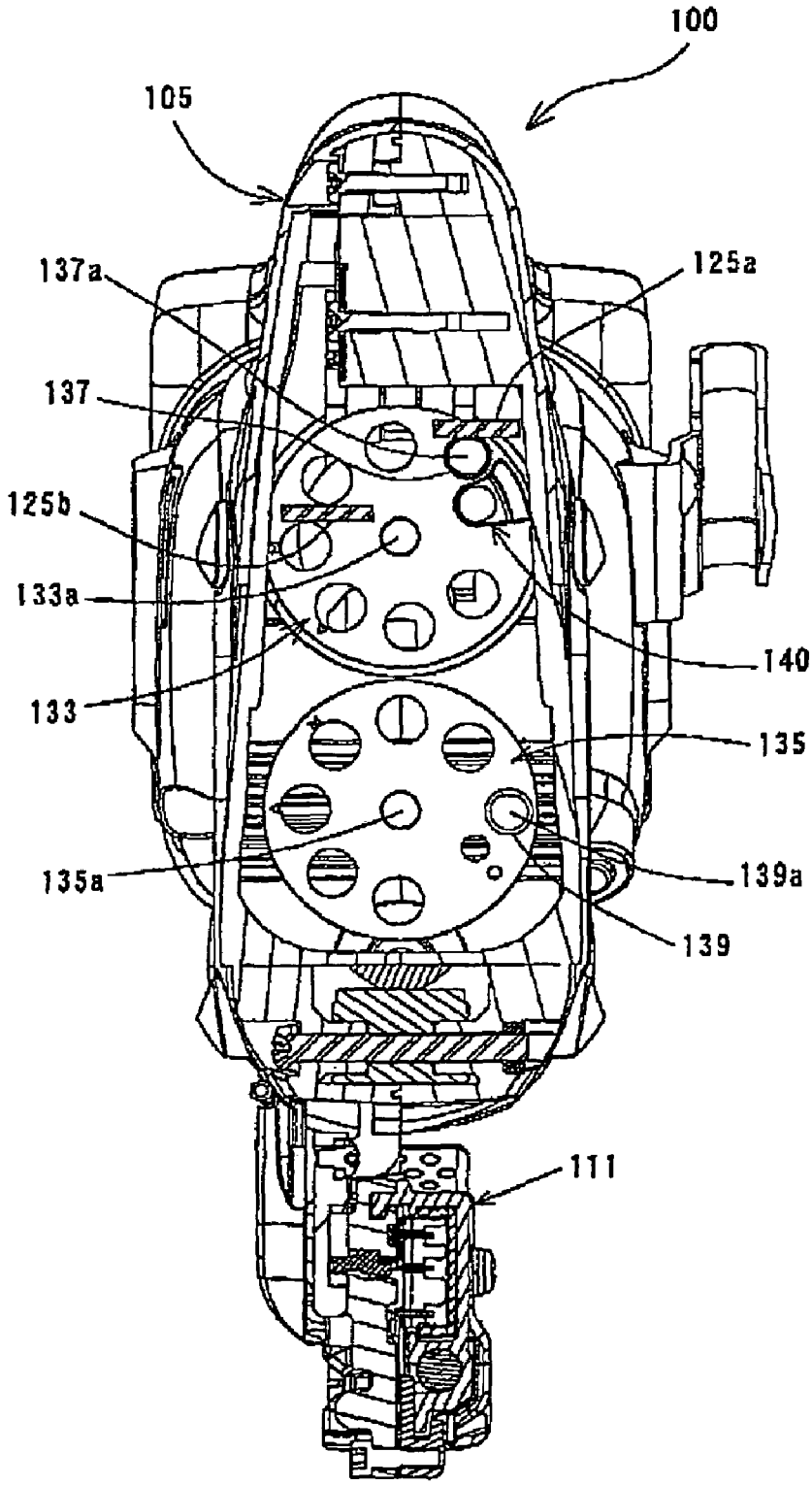
FIG. 33 is a sectional view taken along line A-A in FIG. 1, in the state in which the hammer 125 is in a driving standby position.
Figure 36:
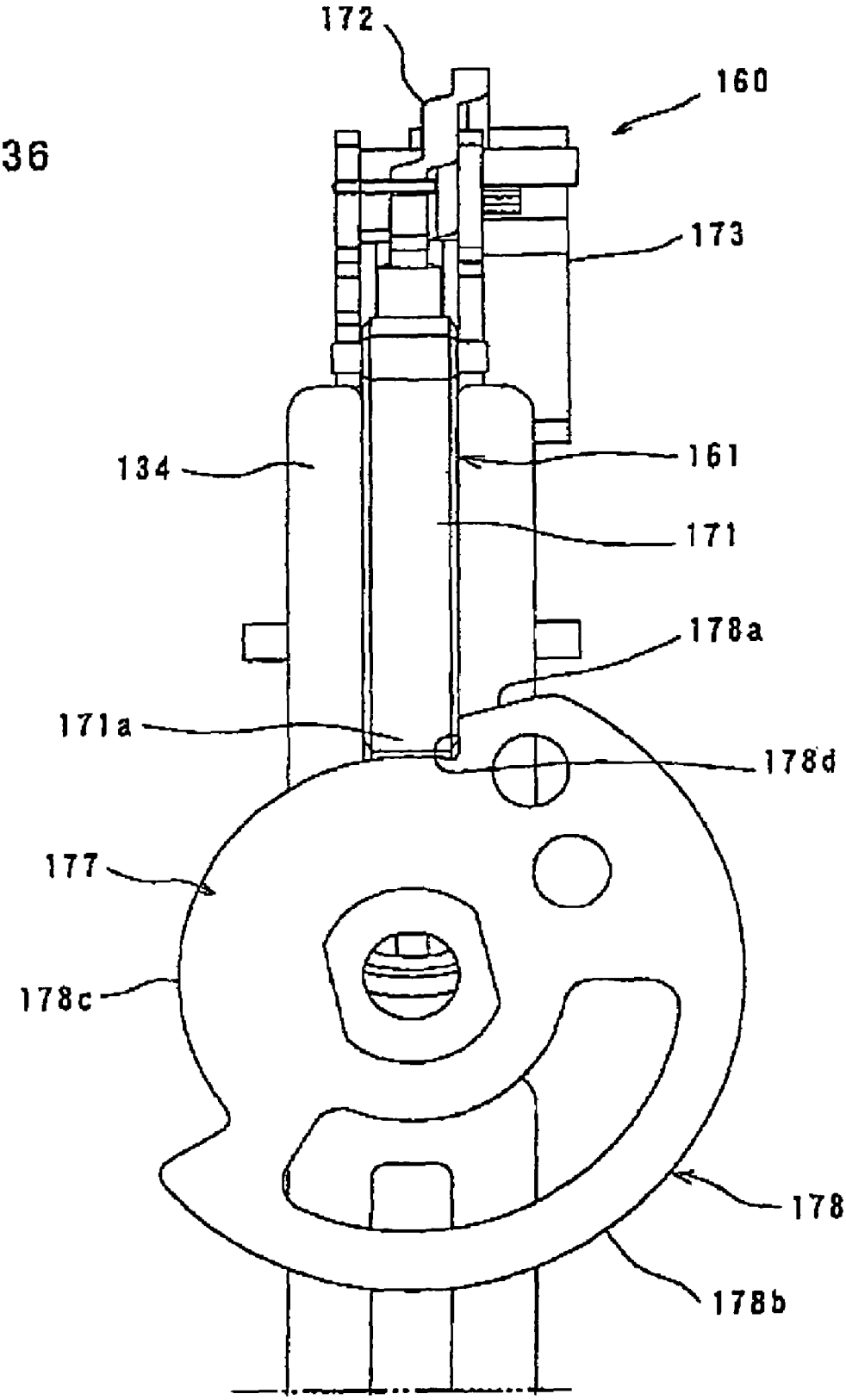
FIG. 36 shows an operating device 160 for controlling energization and de-energization of a driving motor 113 according to this embodiment.

The cam disc 177 further continues to rotate until the end of the cam block 171 reaches small-diameter region 178*c* of the cam disc 177. When the end of the cam block 171 reaches the small-diameter region 178*c*, the cam block 171 is moved in a direction opposite to the depressing direction of the trigger 141 via the switch arm 172 and the push pin 174 by the biasing force of the first torsion spring 175. As a result, the second switch 173 is returned to the off position and the driving motor 113 is de-energized. This state is shown in FIGS. 18, 19 and 29. Thereafter, the driving motor 113 continues to rotate by inertia while being braked and then stops. As a result, the cam disc 177 also rotate and returns to the initial position at the end of the small-diameter region 178*c*. Further, each of the component parts of the hammer drive mechanism 119 also returns to its initial position When the user releases the trigger 141 to stop the depressing operation, the trigger 141 returns to the pre-operational or released position by the biasing force of the compression coil spring 165. At this time, when the swing arm 164 moves together with the trigger 141, the free leg 166*b* of the second torsion spring 166 is pushed in contact with the inclined surface portion 169*b* of the guide surface 169. Thus, the swing arm 164 moves in an attempt to return to the initial position or the interlocked position. This state is shown in FIGS. 20, 21 and 30. At this time, the swing arm 164 contacts the underside of the engagement portion 171*a* of the cam block 171, and the second torsion spring 166 is guided by the inclined surface portion 169*b* of the guide surface 169 and elastically deforms. By such elastic deformation, the swing arm 164 passes in contact with the underside of the engagement portion 171*a* and returns to the initial position or interlocked position shown in FIGS. 4, 5 and 22. Further, when the second torsion spring 166 moves as guided by the inclined surface portion 169*b* of the guide surface 169, the second torsion spring 166 deforms the third torsion spring 167 and returns it to the initial position while deforming per se. As a result, the third torsion spring 167 is (additionally) provided with a biasing force of rotating the swing arm 164 from the interlocked position to the interlock released position. Thus, one diving operation of driving in a pin by the driver 129 is completed.

The user may possibly discontinue the depressing operation of the trigger 141 halfway through the driving operation of the driver 129, for example, during the process of lifting the driver 129 from the bottom dead center to the top dead center. At this time, in the operating device 160 of this embodiment, the second switch 173 associated with the internal switch 161 is held in the on position, but the first switch 148 associated wit the trigger switch 163 is returned to the off position when the trigger 141 returns to the released position. Therefore, the driving motor 113 is de-energized and thus the driving operation can be stopped in progress. Further, after such interruption, when the trigger 141 is depressed again to turn on the first switch 148, the driving motor 113 is energized. Specifically, the once interrupted driving operation of the driver 129 can be resumed without causing a problem.

As described above, in a fist operation mode of the operating device 160 according to this embodiment when the trigger 141 is depressed, the first switch 148 is turned on, and the second switch 173 is interlocked with the depressing operation of the trigger 141 to be turned on and held in the on position. When the trigger 141 is released, the first switch 148 is returned to the off position. The first operation mode corresponds to the "first mode" according to this invention.

Further, in a second operation mode, when the depressing operation of the trigger 141 is continued, the first switch 148 is held in the on position, and the second switch 173 is held in the on position for a predetermined period of time in the working stroke and then returned to the off position. The second operation mode corresponds to the "second mode" according to this invention. The working stroke of the driving member is started when the operating device 160 is put into the first operation mode by the depressing operation of the trigger 141. After a predetermined period of time elapses after start of the working stroke, the operating device 160 switches from the first operation mode to the second operation mode.

According to the representative embodiment, each time the trigger 141 is depressed once, the driver 129 is caused to perform one driving operation and then stopped. Such movement can be performed only by depressing the trigger 141. Therefore, compared with the prior art which requires an operation of pressing a contact detection arm against a workpiece and an operation of depressing a trigger, the operability of the operating device 160 can be enhanced Further, in this embodiment, the depressing direction of the trigger 141 is the same as the moving direction of the cam block 171. With this construction, the system of interlocking the cam block 171 with the depressing operation of the trigger 141 can be easily designed. Further, interlocking between the trigger 141 and the cam block 171 and release of the interlock is done by the rotatable swing arm 164. To this end, the swing arm 164 is formed by a fit between a shaft and a hole. Therefore, machining accuracy can be readily insured and smooth movement can be realized. Further, by utilizing the elastic deformation of the second torsion spring 166, the swing arm 164 can be efficiently returned from the interlock released position to the interlocked position while being cased to interfere with the cam block 171.

Further, in this embodiment, the cam block 171 turns on the second switch 173 by interlocking with the depressing operation of the trigger 141. The cam block 171 is controlled by the rotatable cam disc 177, and the cam disc 177 is rotated together with the gear 133 of the hammer drive mechanism 119 that drives the hammer 125. Therefore, the time at which the cam block 171 turns the second switch 173 on and off can be readily adjusted with respect to the time at which the hammer drive mechanism 119 drives the hammer 125. Further, the time at which the first switch 148 is turned off, or the time at which the driving motor 113 is de-energized, can be adjusted in consideration of the position where the driving motor 113 stops after being braked. In this embodiment, the braking region for braking the driving motor 113 is provided in the small-diameter region 178*a* of the cam disc 177. As a result, after de-energization of the driving motor 113, the driving motor 113 and the hammer drive mechanism 119 can be stopped with a relatively small impact thereupon.

Further, in this embodiment, the trigger 141 and the cam block 171 are interlocked with each other or such interlock is released by rotation of the swing arm 164 between the interlocked position and the interlock released position. Alternatively, in place of the swing arm 164, a sliding member that linearly moves in a direction crossing the depressing direction of the trigger 141 may be provided and interlocks the trigger 141 and the cam block 171 or releases the interlock by moving between the interlocked position and the interlock released position. Further, in this embodiment, the pin tucker 100 is described as a representative example of the power tool in the present invention. However, the present invention is not limited to the pin tucker 100, but may be applied to any power tools of the type which performs the driving movement of the hammer 125 by a spring force of the compression coil spring 127.

Further, according to the representative embodiment, the speed reducing mechanism 115 includes a "reverse rotation preventing mechanism" that prevents reverse rotation in a direction opposite to the direction of rotation (normal rotation) when the motor 113 is driven. A ratchet wheel 116 and a leaf spring 118, which will be described below, form his reverse rotation preventing mechanism. The reverse rotation preventing mechanism of the speed reducing mechanism 115 is shown in FIGS. 34 and 35. FIG. 34 shows the ratchet wheel 116 and the leaf spring 118 forming the reverse rotation preventing mechanism of the speed reducing mechanism 115 in this embodiment, as viewed from the side of the driving mechanism 117 in FIG. 3. FIG. 35 is a side view of the ratchet wheel 116 and the leaf spring 118 shown in FIG. 34.

As shown in FIGS. 34 and 35, the ratchet wheel 116 has a disc-like shape and is mounted on the output shaft 115*a* of the speed reducing mechanism 115. A plurality of engagement grooves 116*a* are provided in the circumferential region (the ratchet face on the outer circumferential portion) of the ratchet wheel 116. Each of the engagement grooves 116*a* includes a vertical wall 116*b* extending horizontally as viewed in FIG. 35 and an inclined wall 116*c* extending obliquely from the bottom of the vertical wall 1II b. Further, a leaf spring 118 is provided to face the ratchet face of the ratchet wheel 116 and is allowed to rotate on the output shaft 115*a* (corresponding to the "support portion" according to this invention) with respect to the ratchet wheel 116. The leaf spring 118 includes an engagement claw 118*a*, a first contact piece 118*b* and a second contact piece 118*c* on the outer edge portion. The engagement claw 118*a* is configured to extend along the inclined wall 116*c* of the engagement groove 116*a* of the ratchet wheel 116 and can press and engage with the engagement groove 116*a* In engagement with the engagement groove 116*a*, when the driving motor 113 is driven, the engagement claw 118*a* allows the ratchet wheel 116 to rotate in the direction of an arrow 10 in FIG. 34 (in the normal or forward direction) and prevents the ratchet wheel 116 to rotate in the direction of an arrow 12 in FIG. 34 (in the reverse direction).

Specifically, when the ratchet wheel 116 rotates in the normal direction ("rotates in one direction of the ratchet wheel" according to this invention), the inclined wall 116*c* of each of the engagement grooves 116*a* slides with respect to the engagement claw 118*a* and the engagement claw 118*a* comes into engagement with the engagement grooves 116*a* one after another along the circumferential region of the ratchet wheel 116. Thus, the ratchet wheel 116 is allowed to rotate in the normal direction. On the other hand, when the ratchet wheel 116 rotates in the reverse direction ("rotates in the other direction of the ratchet wheel" according to this invention), the engagement claw 118*a* butts against the vertical wall 116*b* of any predetermined one of the engagement grooves 116*a*. Thus, the engagement claw 118*a* is locked in the engagement groove 116*a* and held in the locked state. As a result, the ratchet wheel 116 is prevented from rotating in the reverse direction. The leaf spring 118 is a feature that corresponds to the "claw member" according to this invention.

In the construction shown in FIG. 34, the center of rotation of the leaf spring 118 coincides with the center of rotation of the ratchet wheel 116. In this invention, however, the centers of rotation of the leaf spring 118 and the ratchet wheel 116 may coincide with each other or may be displaced from each other. Further, in the construction shown in FIG. 34, the plurality of the engagement grooves 116*a* are provided in the circumferential region of the ratchet wheel 116. In this invention, however, engagement grooves corresponding to the engagement grooves 116*a* may be provided on the outer peripheral portion of the ratchet wheel 116 having a circular arc surface, and a member having an engagement claw adapted to the engagement grooves may be used in place of the leaf spring 118.

When the driving motor 113 is driven and the ratchet wheel 116 rotates on the output shaft 115*a* in the normal direction, the leaf spring 118 may be dragged by the ratchet wheel 116 in the same direction and rotated with rotation of the ratchet wheel 116 by the frictional force between the engagement claw 118*a* and the engagement grooves 116*a* (the inclined wall 116*c*) held in engagement with each other. Therefore, in this embodiment, the leaf spring 118 is configured to have the first contact piece 118*b* that can contact a fist contact wall 105*a* of the gear housing 105. With this construction, the leaf spring 118 rotates on the output shaft 115*a* in the direction of the arrow 10 in FIG. 34 until the first contact piece 118*b* contacts the first contact wall 105*a* in a first stop position (shown by a solid line in FIG. 34). Thus, further normal rotation of the leaf spring 118 is prevented in the fist stop position. The first stop position, the first contact piece 118*b* and the first contact wall 105*a* are features that correspond to the "first position", the "first contact portion" and the "first contacted portion", respectively, according to this invention.

When the ratchet wheel 116 rotates in the reverse direction and the leaf spring 118 rotates in the same direction as the ratchet wheel 116 by the force of engagement between the engagement claw 118*a* and the engagement grooves 116*a*, the second contact piece 118*c* contacts a second contact wall 105*b* of the gear housing 105 in a second stop position (shown by a phantom line in FIG. 34). Thus, further reverse rotation of the leaf spring 118 is prevented in the second stop position. The second stop position, the second contact piece 115*c* and the second contact wall 105*b* arm features that correspond to the "second position", the "second contact portion" and the "second contacted portion", respectively, according to this invention.

In other words, the leaf spring 118 is allowed to rotate with a predetermined amount of play (a clearance 106 (d1) in FIG. 34) between the first stop position in which the first contact piece 118*b* contacts the first contact wall 105*a* and the second stop position in which the second contact piece 118*c* contacts the second contact wall 105*b*. Therefore, although the ratchet wheel 116 is prevented from rotating with respect to the leaf spring 118 in the direction of the arrow 12, the leaf spring 118 itself is allowed to rotate in the reverse direction from the second stop position to the first stop position, which results in the ratchet wheel 116 being allowed to rotate in the reverse direction together with the leaf spring 118.

Figure 37:
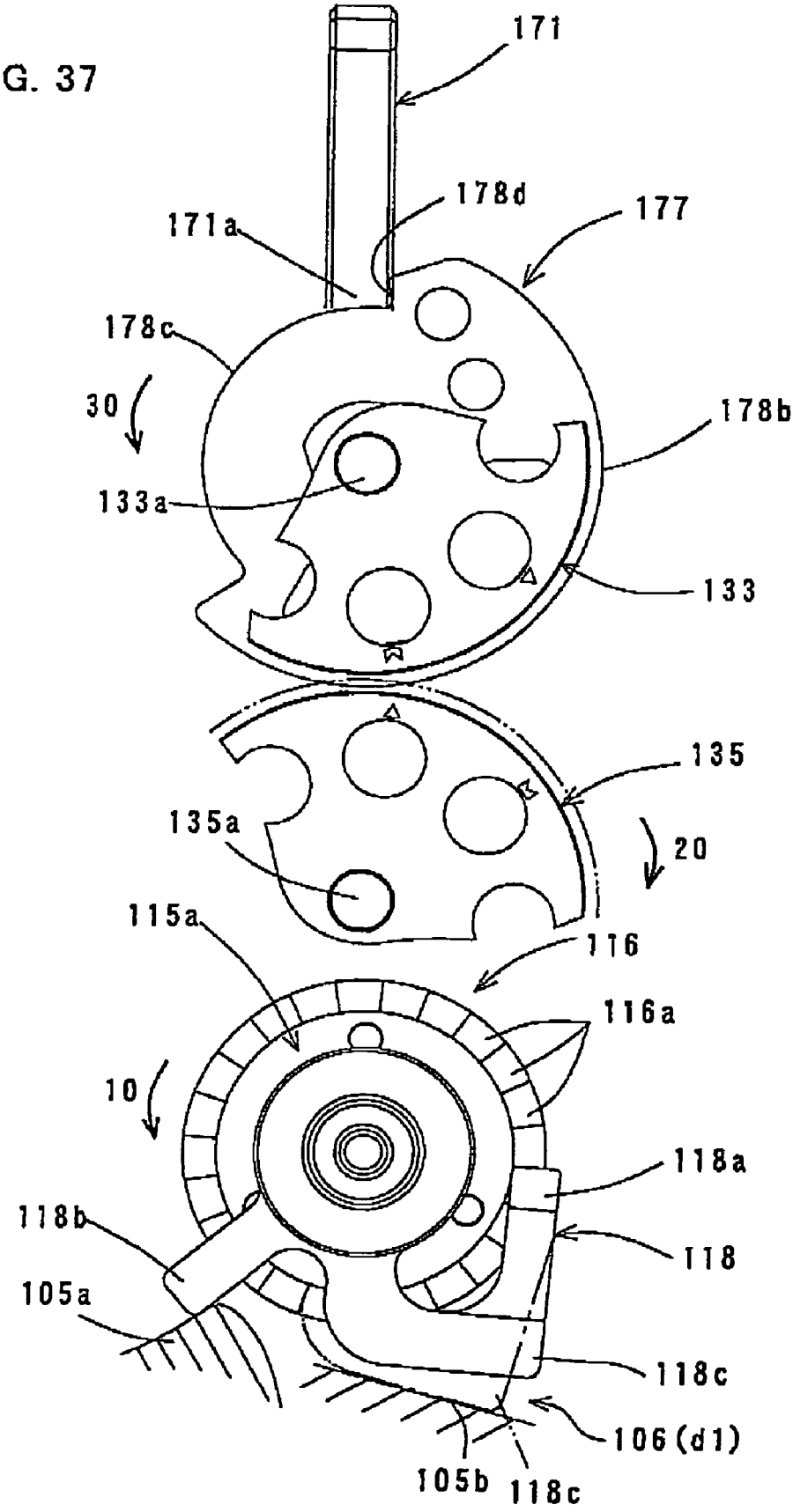
FIG. 37 shows a reverse rotation preventing mechanism in the state in which an end 171*a* of a cam block 171 is butted against a stopper surface 178*d* of a cam disc 177 after completion of the working stroke of the driving operation.
Figure 38:
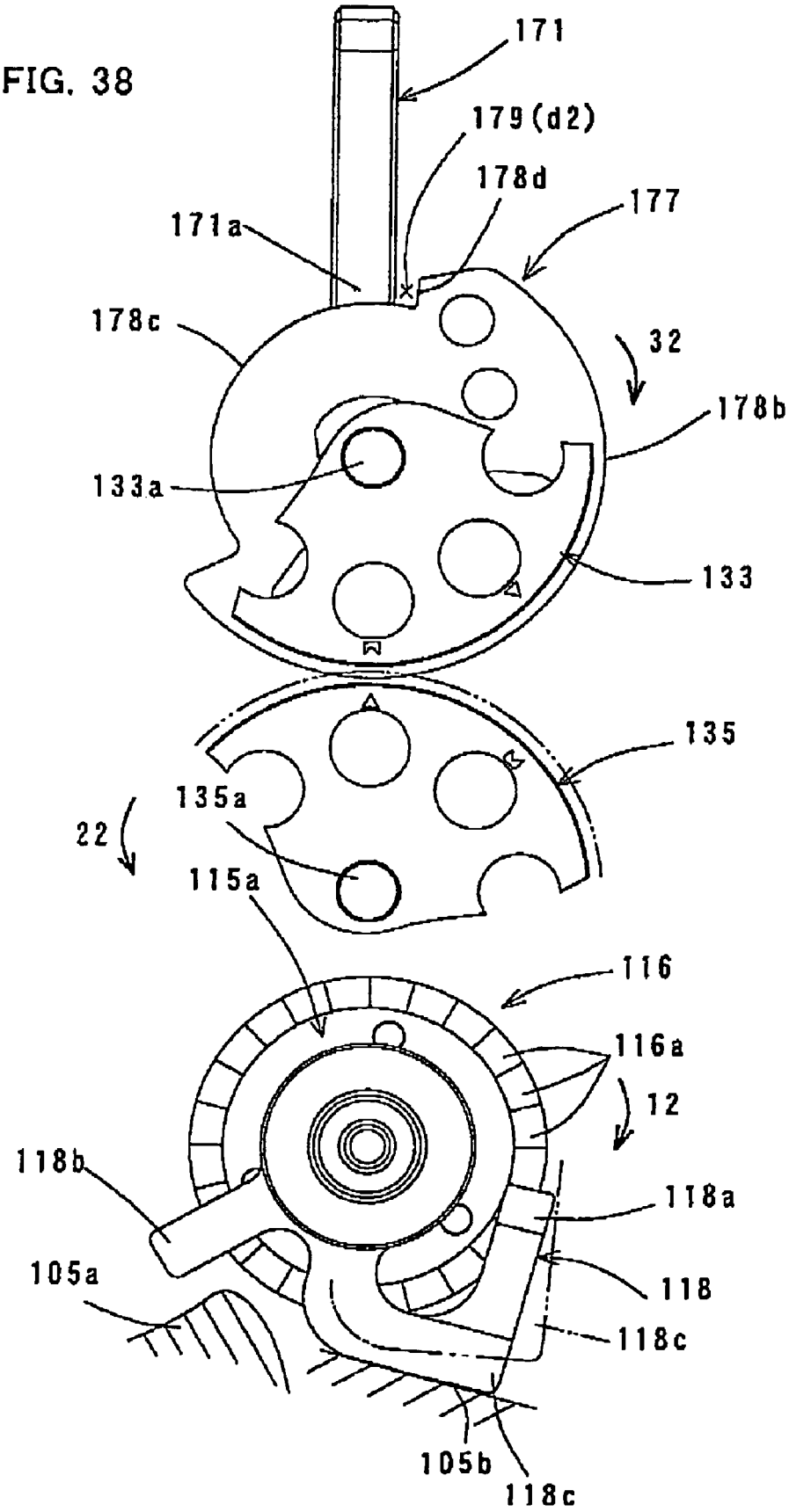
FIG. 38 shows the reverse rotation preventing mechanism is in the state in which the end 171*a* of the cam block 171 is disengaged from the stopper surface 178*d* of the cam disc 177.

An operation of the reverse rotation preventing mechanism of the speed reducing mechanism 115 will now be explained with reference to FIGS. 37 and 38. FIG. 37 shows the reverse rotation preventing mechanism in the state in which the end 171*a* of the cam block 171 is butted against the stopper surface 178*d* of the cam disc 177 after completion of the working stroke of the driving operation. FIG. 38 shows the reverse rotation preventing mechanism in the state in which the end 171*a* of the cam block 171 is disengaged from the stopper surface 178*d* of the cam disc 177.

As shown in FIG. 37, immediately after completion of the working stroke of the driving operation, the cam disc 177 is acted upon by inertial force in the normal direction (in the direction of the arrow 30 in FIG. 37). Thus, the end 171*a* of the cam block 171 is in contact with the stopper surface 178*d* of the can disc 177. The inertial force upon the cam disc 177 is transmitted as a rotating force of the output shaft 115*a* in the direction of the arrow 10, a rotating force of the lower gear 135 in the direction of the arrow 20 and a rotating force of the upper gear 133 in the direction of the arrow 30, in this order from the driving motor 113 side. Further, immediately after completion of the working stroke of the driving operation, the engagement claw 118*a* of the leaf spring 118 is in engagement with the engagement groove 116*a* of the ratchet wheel 116, and the first contact piece 118*b* is in contact with the first contact wall 105*a* of the gear housing 105. Thus, the leaf spring 118 is prevented from being dragged by the ratchet wheel 116 in the same direction and rotated with rotation of the ratchet wheel 116.

When the end 171*a* of the cam block 171 is in contact with the stopper surface 178*d* of the cam disc 177 and also the leaf spring 118 is in engagement with the ratchet wheel 116, the cam block 171 may conceivably be locked. In such a locked state, even if the trigger 141 is depressed, the end 171*a* of the cam block 171 cannot be disengaged from the stopper surface 178*d*, so that the cam block 171 cannot be raised.

Therefore, in this embodiment, even in the state in which the end 171*a* of the cam block 171 is in contact with the stopper surface 178*d* of the cam disc 177 and also the leaf spring 118 is in engagement with the ratchet wheel 116, a predetermined amount of reverse rotation of the ratchet wheel 116 and the leaf spring 118 in engagement with each other is allowed. Specifically, as described above, the leaf spring 118 is allowed to rotate with a predetermined amount of play (the clearance 106 (d1) in FIG. 37) between the first stop position in which the first contact piece 118*b* contacts the first contact wall 105*a* and the second stop position in which the second contact piece 118*c* contacts the second contact wall 105*b*. At this time, the biasing force of the compression coil spring 127 acts upon the ratchet wheel 116 via the speed reducing mechanism 115 in a direction to rotate the ratchet wheel 116 in the reverse direction. Therefore, the ratchet wheel 116 acted upon by the biasing force of the compression coil spring 127 rotates in the reverse direction by a distance corresponding to the amount d1 of the clearance 106, together with the leaf spring 118 with the engagement claw 118*a* in engagement with the associated engagement groove 116*a*. When the leaf spring 118 rotates on the output shaft 115*a* in the direction of the arrow 12 in FIG. 38 and reaches the second stop position, the second contact piece 118*c* contacts the second contact wall 105*b*. Thus, further reverse rotation is prevented.

The construction in which the leaf spring 118 can rotate between the first stop position and the second stop position, the construction in which the first contact piece 115*b* of the leaf spring 118 contacts the first contact wall 105*a* in the first stop position, and the construction in which the second contact piece 118*c* of the leaf spring 118 contacts the second contact wall 105*b* in the second stop position form the "release mechanism" according to this invention.

In the process in which the ratchet wheel 116 rotates together with the leaf spring 118 in the reverse direction by a distance corresponding to the amount d1 of the clearance 106, the cam disc 177 also rotates in the reverse direction. Thus, as shown in FIG. 38, the end 171*a* of the cam block 171 is displaced a predetermined (by an amount of the clearance 179) away from the stopper surface 178*d* of the cam disc 177 and held in the contact release state in which the cam block 171 and the cam disc 177 are disengaged from each other. Specifically, when the clearance 106 between the second contact piece 118*c* of the leaf spring 118 and the second contact wall 105*b* is gone, the clearance 179 (d2) is created between the end 171*a* of the cam block 171 and the stopper surface 178*d* of the cam disc 177. In this embodiment, the clearance 106 between the second contact piece 118*c* of the leaf spring 118 and the second contact wall 105*b* defines the amount of reverse rotation of the cam disc 177.

The rotating force of this reverse rotation of the cam disc 177 is transmitted to the compression coil spring 127, the upper engagement projection 125*a* of the hammer 125 and the shaft 137*a* of the upper lift roller 137 in this order. With the clearance 179 (d2) created between the end 171*a* of the cam block 171 and the stopper surface 178*d* of the cam disc 177, contact in engagement between the cam block 171 and the stopper surface 178*d* can be avoided and the cam block 171 is prevented from being locked. As a result, the depressing operation of the trigger 141 can be smoothly performed.

DESCRIPTION OF NUMERALS

100 pin tucker (power tool)

101 body

103 motor housing

105 gear housing

105*a* first contact wall

105*b* second contact wall

106 clearance

107 handgrip

109 battery case

111 magazine

112 injection part

112*a* pin injection post

113 driving motor (motor)

115 speed reducing mechanism

115*a* output shaft

115*b* driving gear

116 ratchet wheel

116*a* engagement groove

116*b* vertical wall

116*c* inclined wall

117 driving mechanism

118 leaf spring

118*a* engagement claw

118*b* first contact piece

118*c* second contact piece

119 hammer drive mechanism (operating mechanism)

121 slide guide

123 slider

125 hammer

125*a* upper engagement projection

125*b* lower engagement projection

126 stopper

127 compression coil spring

129 driver (driving member)

131 connecting pin

133 upper gear

133*a* shaft

134 frame

135 lower gear

135*a* shaft

137 upper lift roller

137*a* support shaft

139 lower lift roller

139*a* support shaft

140 cam

141 trigger

143 safety lever

145 light

147 light illuminating switch

148 first switch

160 operating device

161 internal switch

163 trigger switch

163*a* shaft

163*b* lever

164 swing arm (interlocking member)

164*a* end surface

165 compression coil spring

166 second torsion spring (elastic member, second spring member)

166*a* one leg

166*b* other (free) leg

167 third torsion spring (first spring member)

167*a* one leg

167*b* other (free)leg

168 guide plate (guide member)

169 guide surface

169*a* flat surface portion

169*b* inclined surface portion

171 cam block

171*a* engagement portion

172 switch arm

172*a* shaft

173 second switch

174 push pin

174*a* biasing spring

175 first torsion spring

177 cam disc (control member)

178 cam face

178*a* rake region (interlock released region)

178*b* large-diameter region (on-state continuation region)

178*c* small-diameter region (off-state return region)

178*d* stopper surface

179 clearance

We claim:

1. A power tool comprising:

a body having a motor housing, a handgrip, and a gear housing, the gear housing having a driving member and a hammer drive member, the hammer drive member having an upper gear and a lower gear positioned within the gear housing so as to be rotatable in opposing directions on a longitudinal axis wherein one working stroke comprises one rotation of the upper gear and the lower gear;

a motor disposed in the motor housing;

a trigger;

an interlocking member;

a hammer having an upper and a lower engagement projection;

a compression coil spring;

an operating device having a first mode, a second mode, a trigger switch biased into an off position, and an internal switch biased into an off position, the trigger switch and the internal switch operatively connected for completing one working stroke after finishing the first mode and the second mode, the first mode comprising the internal switch moving to an on position by interlocking with the trigger switch while the trigger switch is in an on position, the trigger switch being activated to the on position in response to a linear depression applied to the trigger, thereby energizing the motor for a predetermined period of time as the first mode, before de-energizing the motor after the predetermined period of time as beginning the second mode, the second mode comprising the internal switch releasing its interlocking position with the trigger switch and returning to the off position in response to the predetermined period of time ending, and the trigger switch remaining in the on position during the second mode;

a cam block provided in the internal switch adapted to linearly move with depressing operation of the trigger; and a switch arm provided in the internal switch rotatably adapted for rotation by the cam block, biased by a first torsion spring.

2. The power tool as defined in claim 1, wherein:

the trigger switch further comprises a finger operating member for depressing in the operating direction and an interlocking member operatively connected to the finger operating member having an operating position and a non-operating position, wherein the trigger switch is interlocked with the internal switch as the operating position and interlock releases to comprise the non-operating position, wherein the interlocking member, normally biased into a non-operating position, is provided with a swing arm being movable in response to a biasing force, the interlocking member adapted to be held in the operating position against a biasing force by contact with the internal switch in the first mode, and further adapted to be switched from the operating position to the non-operating position, thereby releasing contact with the internal switch in response to the internal switch further moved in a trigger depressing direction in a manner such that the interlocking member is switched from the operating position to the non-operating position and released from the interlock with the internal switch.

3. The power tool as defined in claim 2 further comprising a guide member for guiding the interlocking member to be switched from the non-operating position to the operating position in response to the finger operating member returning to a pre-operational position by release of the depressing operation of the finger operating member, a second torsion spring provided on the swing ARM wherein at completion of the second mode, the interlocking member is guided by a guide member from the non-operating position to the operating position in response to release of the depressing operation of the finger operating member.

4. The power tool as defined in claim 3 further comprising a first spring member biasing the interlocking member into the non-operating position and a second spring member defined by the second torsion spring, the first and second spring members configured with each other such that the respective biasing forces act upon each other, wherein, when the interlocking member is switched from the operating position to the non-operating position in response to a biasing force of the first spring member, the second spring member transmits the biasing force of the first spring member to the interlocking member as a force of moving the interlocking member from the operating position to the non-operating position, and when the interlocking member is switched from the non-operating position to the operating position, the first spring member is returned to an initial position by the second spring member guided by the guide member.

5. The power tool as defined in claim 2, wherein the interlocking member is configured for rotation in a direction crossing the depressing direction of the finger operating member.

6. The power tool as defined in claim 5, further comprising the interlocking member being rotatably configured in such a manner to have surface contact the internal switch in the depressing direction in response to depression of the finger operating member, in the operating position in response to frictional force of the surface contact, and rotate to the non-operating position in response to biasing force of the second torsion spring when the interlocking member is disengaged from the internal switch and the frictional force ceases to exist.

7. The power tool as defined in claim 5, further comprising the interlocking member being slidable in respect to the internal switch in response to movement of the finger operating member in a direction opposite to the depressing direction of the finger operating member.

8. The power tool as defined in claim 1, the internal switch further comprising an operating member defined by the cam block and a control member defined by a cam disc, the operating member being movable in a throwing direction in response to the internal switch moved to the on position and the control member being moveable in response to the motor and configured to control movement of the operating member switching between the first mode and the second mode, the control member further comprising:

an interlock release releasing the interlock between the operating member and the trigger switch while holding the internal switch in the on position, an on-state continuation region adjacent to the interlock release for holding the internal switch in the on position after release of the interlock, and an off-state return region adjacent to the on-state continuation region for allowing the operating member to move in a direction opposite to the throwing direction by disengagement from the operating member.

9. The power tool as defined in claim 8, further comprising a braking region provided in the off-state return region for enabling the motor to be braked after the motor is de-energized.

10. The power tool as defined in claim 1 further comprising:

a drive device for driving the coil spring in a winding direction against the spring force of the coil spring, a rotating element configured for rotation in a normal direction against the spring force of the coil spring having a locked part and a driving standby position, a locking member contacting the locked part of the rotating element for locking the rotating element in a driving standby position in response to drive means winding and driving the coil spring, and further locking the rotating element in the driving standby position in response to the rotating element rotating one turn in the normal direction after releasing the lock, a reverse rotation preventing mechanism adapted for allowing the rotating element to rotate in the normal direction and preventing the rotating element from rotating in a reverse direction, and a release mechanism adapted for allowing a predetermined amount of reverse rotation of the rotating element by the reverse rotation preventing mechanism, avoiding contact in engagement between the locked part of the rotating element and the locking member, when driving of the drive means is stopped and the rotating element is locked in the driving standby position via the locking member.

11. The power tool as defined in claim 10, wherein:

the reverse rotation preventing mechanism further comprises a claw member having an engagement claw, a first contact portion, a second contact portion, a first position, a second position, and a ratchet wheel, the ratchet wheel having a plurality of engagement grooves provided in its circumferential region, configured to engage with the engagement claw, and adapted to be rotatable through interlocking with the rotating element, wherein as first position in response to the ratchet wheel rotating in one direction, the engagement claw engages with the engagement grooves along the circumferential region of the ratchet wheel, in a manner such that the rotating element is able to rotate in the normal direction, and in response to the ratchet wheel rotating in a second direction, the engagement claw locks in one engagement groove, in a manner to prevent the rotating element from rotation in the reverse direction, and wherein as the second position in response to the ratchet wheel rotating in the one direction, the release mechanism continues to allow the normal rotation of the rotating element by the reverse rotation preventing mechanism, and in response to the ratchet wheel rotating in opposite direction, the engagement claw engages with the predetermined engagement groove while rotating in the other direction together with the ratchet wheel, in a manner to allow the release mechanism a predetermined amount of reverse rotation of the rotating element.

12. The driving power tool as defined in claim 11, the release mechanism further comprising a support portion rotatably provided to support the claw member between the first position and the second position, a first contacted portion configured to contact the first contact portion of the claw member in the first position, and a second contacted portion configured to contact the second contact portion of the claw member in the second position, wherein the release mechanism is arranged in such a manner that in response to the ratchet wheel rotating in one direction, the release mechanism continually allows normal rotation of the rotating element by the reverse rotation preventing mechanism, placing the claw member in the first position and the first contact portion in contact with the first contacted portion, thereby creating a predetermined clearance between the second contact portion and the second contacted portion, and wherein the release mechanism is arranged in such a manner that in response to the ratchet wheel rotating in an opposite direction, the engagement claw engages with the predetermined engagement groove while rotating in the opposite direction with the ratchet wheel, the release mechanism further allowing a predetermined amount of reverse rotation of the rotating element, the claw member rotating from the first position to the second position by the predetermined clearance and the second contact portion contacting the second contacted portion, defining the amount of reverse rotation of the rotating element.

13. The power tool as defined in claim 1 wherein the tool is a pin tucker or a nailing machine.

* * * * *